US008227164B2

(12) United States Patent
Sugimoto et al.

(10) Patent No.: US 8,227,164 B2
(45) Date of Patent: Jul. 24, 2012

(54) TONER, AND DEVELOPER, DEVELOPER CONTAINER, PROCESS CARTRIDGE, IMAGE FORMING APPARATUS AND IMAGE FORMING METHOD USING THE TONER

(75) Inventors: Tsuyoshi Sugimoto, Mishima (JP); Naohito Shimota, Numazu (JP); Hiroshi Yamashita, Numazu (JP); Satoshi Ogawa, Nara (JP); Masana Shiba, Numazu (JP); Junichi Awamura, Numazu (JP); Tsuneyasu Nagatomo, Numazu (JP); Masaki Watanabe, Numazu (JP)

(73) Assignee: Ricoh Company, Limited, Tokyo (JP)

( * ) Notice: Subject to any disclaimer, the term of this patent is extended or adjusted under 35 U.S.C. 154(b) by 128 days.

(21) Appl. No.: 12/777,844

(22) Filed: May 11, 2010

(65) Prior Publication Data

US 2010/0310980 A1 Dec. 9, 2010

(30) Foreign Application Priority Data

Jun. 8, 2009 (JP) ..... 2009-137227

(51) Int. Cl.
*G03G 9/00* (2006.01)

(52) U.S. Cl. ..... 430/111.4; 430/108.2; 430/108.4; 430/108.8; 430/109.4

(58) Field of Classification Search ..... 430/111.4, 430/108.2, 108.4, 108.8, 109.4; 399/252
See application file for complete search history.

(56) References Cited

U.S. PATENT DOCUMENTS

| | | | |
|---|---|---|---|
| 7,198,874 | B2 | 4/2007 | Saito et al. |
| 7,214,461 | B2 | 5/2007 | Yamashita et al. |
| 7,323,281 | B2 | 1/2008 | Emoto et al. |
| 7,374,851 | B2 | 5/2008 | Nakayama et al. |
| 7,396,630 | B2 | 7/2008 | Watanabe et al. |
| 7,419,756 | B2 | 9/2008 | Yamashita et al. |
| 7,504,188 | B2 | 3/2009 | Yamada et al. |
| 7,521,164 | B2 | 4/2009 | Nakayama et al. |
| 7,531,281 | B2 | 5/2009 | Tomita et al. |
| 7,563,555 | B2 | 7/2009 | Watanabe et al. |
| 7,629,099 | B2 | 12/2009 | Yamashita et al. |
| 7,695,878 | B2 | 4/2010 | Seshita et al. |
| 7,695,883 | B2 | 4/2010 | Yamada et al. |
| 7,702,271 | B2 | 4/2010 | Yamada et al. |
| 7,709,174 | B2 | 5/2010 | Sugimoto et al. |
| 2006/0079662 | A1 | 4/2006 | Fukui et al. |
| 2007/0218380 | A1 | 9/2007 | Uchinokura et al. |
| 2007/0218381 | A1 | 9/2007 | Uchinokura et al. |
| 2007/0218385 | A1 | 9/2007 | Kojima et al. |
| 2007/0218386 | A1 | 9/2007 | Suzuki et al. |
| 2007/0218387 | A1 | 9/2007 | Ishii et al. |
| 2007/0275315 | A1 | 11/2007 | Nagatomo et al. |
| 2008/0013987 | A1 | 1/2008 | Shoji et al. |
| 2008/0032226 | A1 | 2/2008 | Sugiyama et al. |

(Continued)

FOREIGN PATENT DOCUMENTS

EP 1 965 261 A2 9/2008

(Continued)

*Primary Examiner* — Mark A Chapman
(74) *Attorney, Agent, or Firm* — Oblon, Spivak, McClelland, Maier & Neustadt, L.L.P.

(57) ABSTRACT

A toner, including a colorant; a binder resin; a release agent; and a fixing supplemental component, wherein the toner has a storage elastic modulus G' (Pa) satisfying the following conditions:

$5.0\times10^4<G'<5.0\times10^5$ at 80° C.

$1.0\times10^4<G'<1.0\times10^5$ at 90° C.

$5.0\times10^3<G'<5.0\times10^4$ at 100° C.

$1.0\times10^3<G'<1.0\times10^4$ at 120° C.

$1.0\times10^3<G'<1.0\times10^4$ at 150° C.

16 Claims, 5 Drawing Sheets

U.S. PATENT DOCUMENTS

2008/0057430 A1 3/2008 Takahashi et al.
2008/0069606 A1 3/2008 Yamashita et al.
2008/0069616 A1 3/2008 Kojima et al.
2008/0070144 A1 3/2008 Nagatomo et al.
2008/0070148 A1 3/2008 Awamura et al.
2008/0070151 A1 3/2008 Sugimoto et al.
2008/0076055 A1 3/2008 Sawada et al.
2008/0213682 A1 9/2008 Saitoh et al.
2008/0226356 A1 9/2008 Yasunaga et al.
2008/0227002 A1 9/2008 Moriya et al.
2008/0227009 A1 9/2008 Fuwa et al.
2008/0227015 A1 9/2008 Nagatomo et al.
2008/0227018 A1 9/2008 Awamura et al.
2008/0233496 A1 9/2008 Kotsugai et al.
2008/0233505 A1 9/2008 Nagatomo et al.
2008/0233506 A1 9/2008 Hagi et al.
2008/0280218 A1 11/2008 Sabu et al.
2008/0280219 A1 11/2008 Nakayama et al.
2008/0292361 A1 11/2008 Seshita et al.
2008/0292985 A1 11/2008 Suzuki et al.
2008/0311500 A1 12/2008 Yamada et al.
2008/0318144 A1 12/2008 Watanabe et al.
2008/0318148 A1 12/2008 Sugimoto et al.
2009/0003885 A1 1/2009 Sabu et al.
2009/0017392 A1 1/2009 Higuchi et al.
2009/0041511 A1 2/2009 Fuwa et al.
2009/0061345 A1 3/2009 Yamada et al.
2009/0067876 A1 3/2009 Seshita et al.
2009/0068579 A1 3/2009 Ogawa et al.
2009/0074467 A1 3/2009 Seshita et al.
2009/0092917 A1 4/2009 Sugimoto et al.
2009/0104555 A1 4/2009 Wakamatsu et al.
2009/0142093 A1 6/2009 Sawada et al.
2009/0142094 A1 6/2009 Sawada et al.
2009/0142680 A1 6/2009 Shimota et al.
2009/0142682 A1 6/2009 Saitoh et al.
2009/0142685 A1 6/2009 Nagatomo et al.
2009/0142686 A1 6/2009 Kojima et al.
2009/0142690 A1 6/2009 Awamura et al.
2009/0155709 A1 6/2009 Watanabe et al.
2009/0155710 A1 6/2009 Aoki et al.
2009/0155711 A1 6/2009 Yamashita et al.
2009/0162780 A1 6/2009 Yamashita et al.
2009/0214973 A1 8/2009 Sugimoto et al.
2009/0214975 A1 8/2009 Awamura et al.
2009/0226836 A1 9/2009 Uchinokura et al.
2009/0233204 A1 9/2009 Watanabe et al.
2009/0233218 A1 9/2009 Ogawa
2009/0269692 A1 10/2009 Awamura et al.
2009/0280421 A1 11/2009 Awamura et al.
2009/0325099 A1 12/2009 Watanabe et al.
2010/0035170 A1 2/2010 Sugimoto et al.
2010/0062352 A1 3/2010 Kusahara et al.
2010/0075243 A1 3/2010 Shimota et al.
2010/0075245 A1 3/2010 Watanabe et al.
2010/0081075 A1 4/2010 Watanabe et al.

FOREIGN PATENT DOCUMENTS

EP 1 965 261 A3 9/2008
JP 4-70765 3/1992
JP 2004-245854 9/2004
JP 2006-208609 8/2006

TONER, AND DEVELOPER, DEVELOPER CONTAINER, PROCESS CARTRIDGE, IMAGE FORMING APPARATUS AND IMAGE FORMING METHOD USING THE TONER

BACKGROUND OF THE INVENTION

1. Field of the Invention

The present invention relates to a toner for developing an electrostatic latent image in electrophotography, electrostatic recording and electrostatic printing, and to a developer, a developer container, a process cartridge, an image forming apparatus and an image forming method using the toner.

2. Discussion of the Background

Image formation by electrophotography, electrostatic recording, electrostatic printing, etc. is typically performed by series of processes of forming an electrostatic latent image on an electrostatic latent image bearer (hereinafter referred to as a "photoreceptor" or an "electrophotographic photoreceptor"), developing the electrostatic latent image with a developer to form a visual (toner) image, transferring the visual image onto a recording medium such as papers and fixing the visual image thereon.

The developer includes a one-component developer using only a magnetic toner or a non-magnetic toner and a two-component developer including a toner and a carrier.

As a fixing method used in electrophotography, a heat roller method of directly contacting a heat roller to a toner image on a recording medium upon application of pressure to fix the toner image thereon is typically and widely used in terms of good energy efficiency. The heat roller method needs a large amount of electric power to fix a toner image. Therefore, various methods of reducing power consumption of the heat roller in terms of saving energy. For example, methods of decreasing a heater power for the heat roller when nor producing images and increasing the heat power to rise a temperature thereof when producing images are typically used.

However, about 10 sec standby time is needed to increase a temperature of the heat roller to fix a toner image from a time of sleep, which is a stress for a user. In addition, it is desired that the heater is completely off to reduce power consumption when images are not produced. A fixable temperature of a toner needs decreasing to solve these.

A toner for use in the developer is required to have good low-temperature fixability and storage stability (anti-blocking) with the development of electrophotography, and polyester resins having higher affinity with a recording medium and better low-temperature fixability than styrene resins having been conventionally and typically used as a binder resin for a toner are being more used. For example, Japanese published unexamined application No. 2004-254854 discloses a toner including a linear polyester resin the properties of which such as molecular weight are specified, and 4-70765 discloses a toner including a non-linear cross-linked polyester resin using rosins as an acidic component.

Conventional binder resins for a toner are insufficient to meet market's demands for an image forming apparatus having higher speed and saving more energy, and are very difficult to maintain sufficient fixing strength because fixing time of a fixer is shortened and heat temperature thereof lowers.

The toner including a polyester resin using rosins as disclosed in Japanese published unexamined application No. 4-70765 has good low-temperature fixability and pulverizability, and therefore has an advantage of improving productivity of a toner prepared by pulverization methods. As an alcohol component of the polyester resin, when 1,2-propanediol which is a branched-chain alcohol having 3 carbon atoms is used, the resultant toner has as good offset resistance as when an alcohol having 2 or less carbon atoms is used and has improved low-temperature fixability more than when the alcohol having 2 or less carbon atoms is used. In addition, 1,2-propanediol is more effective for preventing deterioration of storage stability due to lowering of glass transition temperature than a branched-chain alcohol having 4 carbon atoms or more. When such a polyester resin is used as a binder resin for a toner, the resultant toner has low-temperature fixability and improved storage stability.

However, demands for saving energy are more increasing from now, and although a polyester resin improves low-temperature fixability of a toner, in the near future, it is difficult only for the polyester resin to fully comply with the demands for saving energy.

Japanese published unexamined application No. 2006-208609 discloses a method of introducing a fixing supplemental component into a toner to improve low-temperature fixability thereof. Japanese published unexamined application No. 2006-208609 discloses a toner including a fixing supplemental component as a crystal domain to have both of thermostable storage stability and low-temperature fixability. A toner is required to have high durability and satisfy demands for saving more energy with speed up of image forming apparatus, however, a toner is difficult to fully comply with the demands at present and needs further improvement and development.

Because of these reasons, a need exists for a toner applicable in low-temperature fixing systems and being offset resistant.

SUMMARY OF THE INVENTION

Accordingly, an object of the present invention is to provide a toner applicable in low-temperature fixing systems, being offset resistant, without contaminating a fixer and images, and capable of producing high-quality images having good sharpness for long periods.

Another object of the present invention is to provide a developer including the toner.

A further object of the present invention is to provide a developer container containing the developer.

Another object of the present invention is to provide a process cartridge using the toner.

A further object of the present invention is to provide an image forming apparatus using the toner.

Another object of the present invention is to provide an image forming method using the toner.

These objects and other objects of the present invention, either individually or collectively, have been satisfied by the discovery of a toner, comprising:

a colorant;

a binder resin;

a release agent; and a fixing supplemental component, wherein the toner has a storage elastic modulus G' (Pa) satisfying the following conditions:

$$5.0\times10^4<G'<5.0\times10^5 \text{ at } 80^\circ \text{ C.}$$

$$1.0\times10^4<G'<1.0\times10^5 \text{ at } 90^\circ \text{ C.}$$

$$5.0\times10^3<G'<5.0\times10^4 \text{ at } 100^\circ \text{ C.}$$

$$1.0\times10^3<G'<1.0\times10^4 \text{ at } 120^\circ \text{ C.}$$

$$1.0\times10^3<G'<1.0\times10^4 \text{ at } 150^\circ \text{ C.}$$

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
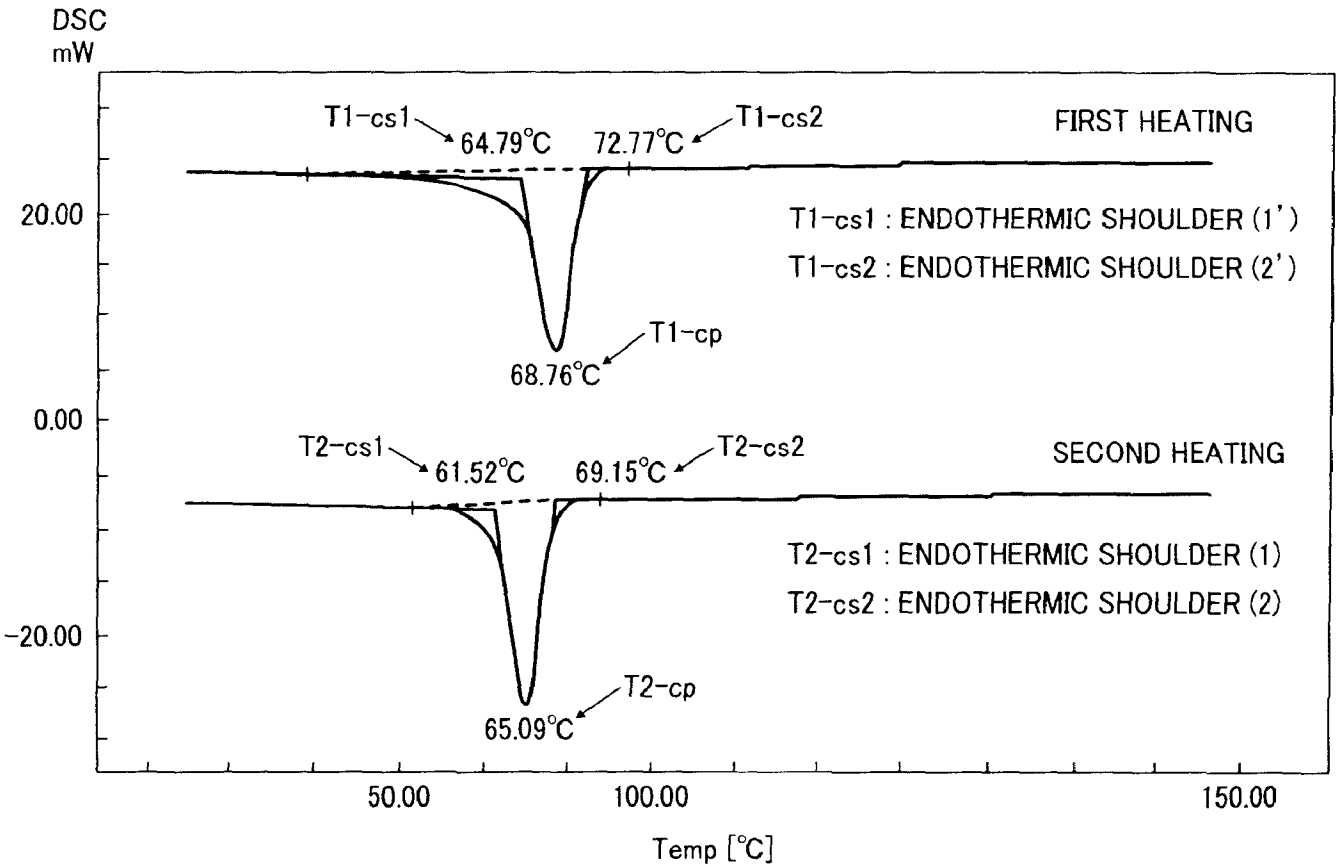
FIG. 1 is a DCS measurement example of the crystalline polyester of the present invention.

The present invention provides a toner applicable in low-temperature fixing systems, being offset resistant, without contaminating a fixer and images, and capable of producing high-quality images having good sharpness for long periods. More particularly, the present invention relates to a toner, comprising:

a colorant;

a binder resin;

a release agent; and a fixing supplemental component, wherein the toner has a storage elastic modulus G' (Pa) satisfying the following conditions:

$5.0\times10^4<G'<5.0\times10^5$ at 80° C.

$1.0\times10^4<G'<1.0\times10^5$ at 90° C.

$5.0\times10^3<G'<5.0\times10^4$ at 100° C.

$1.0\times10^3<G'<1.0\times10^4$ at 120° C.

$1.0\times10^3<G'<1.0\times10^4$ at 150° C.

The toner of the present invention includes at least a colorant, a binder resin, a release agent, a fixing supplemental component and further optional components.

The toner of the present invention has a storage elastic modulus G' satisfying $5.0\times10^4<G'<5.0\times10^5$ at 80° C., $1.0\times10^4<G'<1.0\times10^5$ at 90° C. and $5.0\times10^3<G'<5.0\times10^4$ at 100° C. When the toner has such a steeply-varied viscoelasticity at from 80 to 100° C., the toner has good low-temperature fixability because of plastically deforming at lower temperature when heated to fix and easily adhering to a recording member.

Conventionally, trials of decreasing the viscoelasticity of a toner have been made to have low-temperature fixability. However, the toner possibly melts and adheres in an image developer when receiving a stress such as stirring at high temperature. In the present invention, a fixing supplemental component maintaining high crystallinity until a melting point and quickly changing its viscoelasticity at a melting point is used so that the toner does not melt in an image developer when receiving a stress such as stirring and quickly changes its viscoelasticity at the melting point of the fixing supplemental component. Therefore, the toner has both low-temperature fixability and thermostable storage stability.

Further, the toner of the present invention has a storage elastic modulus G' satisfying $1.0\times10^3<G'<1.0\times10^4$ at 120° C. and $1.0\times10^3<G'<1.0\times10^4$ at 150° C. The toner maintains relatively high viscoelasticity and is difficult to break between a fixing member and a paper, which prevents the toner from adhering to the fixing member.

Conventionally, trials of controlling the viscoelasticity of a binder resin of a toner to improve offset resistance thereof at high temperature. However, in that case, the viscoelasticity at low temperature increases as well, resulting in deterioration of low-temperature fixability. In the present invention, the viscoelasticity at low temperature is steeply varied with the fixing supplemental component and the viscoelasticity at high temperature is secured with a polymeric component of the binder resin. The fixing supplemental component and the polymeric component of the binder resin can independently function because their compatibilities with each other are lowered to some extent.

A toner having a G' of $1.0\times10^5$ Pa or less is typically deformed by a pressure when fixed and fixed on a recording member. The toner of the present invention noticeably lowers G' at 80 to 100° C. and can be fixed on a recording member at a lower temperature than conventional toners.

In order to reduce G', the viscosity of a resin included in a toner is lowered. When the viscosity of the resin is lowered, the glass transition temperature of the toner lowers, resulting in deterioration of the thermostable storage stability thereof. Further, when the viscosity of the resin is lowered, G' at high temperatures noticeably lowers, resulting in occurrence of hot offset of a fixing roller. Hot offset readily occurs when G' is $1.0\times10^3$ Pa or less.

G' at low temperatures can be reduced even when fixing supplemental component, however, hot offset resistance of the resultant toner occasionally deteriorates. In order to maintain hot offset resistance, G' at low temperatures is not fully reduced, resulting in occasional deterioration of low-temperature fixability of the resultant toner.

In the present invention, a material having high crystallinity and good sharp-meltability is used as the fixing supplemental component. When the compatibility between the fixing supplemental component and a binder resin is improved, he fixing supplemental component quickly softens the binder resin and controls a molecular weight distribution, specifically a quantitative ratio of polymeric components to low-molecular-weight components of the binder resin, so as not to impair hot offset resistance. Quickly lowering G' at low temperatures and maintaining G' at high temperatures so as not to occur hot offset can prepare a toner having both low-temperature fixability and hot offset resistance.

In the present invention, G' is measured by, e.g., the following method.

0.8 g of a toner is pressed by a tablet former at a pressure of 400 kgf to form a cylindrical sample having a diameter of 20 mm and a height of 1.9 to 2.1 mm, which is a pellet for measurement.

G' is measured by RheoStress RS50 from HAAKE GmbH at a frequency of 1Hz, a temperature of from 60 to 180° C., a distortion of 0.1 and a temperature rising speed of 3° C./rain, fixing the sample on a parallel plate having a diameter of 20 mm.

The toner of the present invention preferably has a glass transition temperature at first rising temperature (Tg1st) and another glass transition temperature at second rising temperature (Tg2nd), satisfying the following conditions when subjected to a DSC measurement:

$$50° C. < Tg1st < 70° C.$$

$$30° C. < Tg2nd < 50° C.$$

When Tg1st is 50° C. or less, the thermostable storage stability of the toner occasionally deteriorates. When Tg1st is 70° C. or more, the low-temperature fixability of the toner occasionally deteriorates. When Tg2nd is 30° C. or less, images after fixed occasionally deteriorates in heat resistance (anti-blocking). When Tg2nd is 50° C. or more, the low-temperature fixability of the toner occasionally deteriorates.

The fixing supplemental component present as a crystalline domain in the toner of the present invention is compatible with the binder resin when heated.

In order to see the fixing supplemental component has crystallinity, crystallinity holding status (compatible or incompatible) is measured from an X-ray diffraction chart. Specifically, whether the fixing supplemental component has crystallinity in a toner can be seen by a crystal analysis X-ray diffraction apparatus X' Pert MRDX' Pert MRD from Koninklijke Philips Electronics N.V. First, the fixing supplemental component is ground in a mortar to prepare a sample powder, and the sample powder is evenly applied to a sample holder. Then, the sample holder is set in the diffraction apparatus to obtain a diffraction spectrum of the fixing supplemental component. Next, a toner powder is applied to the holder to do the same. The fixing supplemental component included in a toner can be identified from previously prepared diffraction spectra thereof.

The apparatus can measure variation of the diffraction spectrum when the temperature is changed by a heat unit as an accessory. A peak area variation of an X-ray diffraction spectrum coming from the fixing supplemental component at room temperature and at 150° C. can determine a ratio of compatible components to incompatible components of the fixing supplemental component with a resin before an after heated using the unit. The larger the peak area variation, the more compatible with the resin with a heat when the toner is fixed, which achieves a larger effect to low-temperature fixability.

The fixing supplemental component preferably has a diameter of from 10 nm to 3 μm, and more preferably from 50 nm to 1 μm in a longitudinal direction. When less than 10 nm, a contact surface area between the fixing supplemental component and the binder resin increases, resulting in occasional deterioration of thermostable storage stability. When greater than 3 μm, the fixing supplemental component is not fully compatible with the binder resin when the toner is heated to fix, resulting in occasional deterioration of low-temperature fixability thereof.

Methods of measuring the dispersion diameter of the fixing supplemental component are not particularly limited. Specifically, a toner buried in an epoxy resin is ultra-thin sliced to have a thickness about 100 nm and dyed with ruthenium tetroxide to observe with a transmission electron microscope at 10,000 magnifications. The ruthenium tetroxide is photographed and the photograph is evaluated to observe a dispersion status of the fixing supplemental component and measure a dispersion diameter thereof. A difference of contrast made by dyeing the fixing supplemental component and the release agent is previously known to differentiate the fixing supplemental component from the release agent in a toner.

In the present invention, $\Delta Tg = Tgr - Tgr \Longrightarrow > 10°$ C. is preferably satisfied, and $\Delta T = Tgr - Tgr' > 15°$ C. is more preferably satisfied when a polyester resin has a glass transition temperature Tgr and a glass transition temperature Tgr' after a mixture including 90 parts by weight of the polyester resin and 10 parts by weight of the fixing supplemental component is heated at 150° C.

The toner preferably satisfies the following conditions when subjected to differential scanning calorimetry (DSC):

$$50° C. < Tg1st < 70° C.$$

$$20° C. < Tg2nd < 50° C.$$

wherein Tg1st and Tg2nd are glass transition temperatures of the toner when heated for the first time and second time, respectively. When the Tg1st is less than 50° C., the toner occasionally deteriorates in thermostable storage stability. When the Tg1st is not less than 70° C., the toner occasionally does not have sufficient low-temperature fixability because the toner changes its viscoelasticity at high temperature. When Tg2nd is not greater than 20° C., the resultant toner occasionally deteriorates in thermostable storage stability because of low thermal properties when the fixing supplemental component and the binder resin are compatible with each other. When Tg2nd is not less than 50° C., the resultant toner occasionally deteriorates in low-temperature fixability because the fixing supplemental component and the binder resin are not fully compatible with each other.

The endothermic peak temperature (T2-cp) of the crystalline polyester, the endothermic shoulder temperatures (T2-cs1 and T2-cs2) thereof, Tg1st and Tg2nd of a toner, endothermic peak thereof (Qn n=1, 2, 3 . . . ), and Tgr and Tgr' of a polyester binder resin can be measured by, e.g., a DSC system (differential scanning calorimeter) DSC-60 from Shimadzu Corp.

-Endothermic Peak Temperature (T2-cp) and Endothermic Shoulder Temperatures (T2-cs1 and T2-cs2) of the Crystalline Polyester Measurement Method- FIG. 1 is a DCS measurement example of the crystalline polyester.

In the present invention, endothermic peak and shoulder temperatures of crystalline polyesters, amorphous polyesters and toners can be measured by, e.g., a DSC system (differential scanning calorimeter) DSC-60 from Shimadzu Corp.

The endothermic shoulder (1') (=T1-cs1), (1) (=T2-cs1) peak, (2') (=T1-cs2) and (2) (=T2-cs2) peak are specifically measured by the following method.

First, about 5.0 mg of a polyester resin is placed in a sample container made of aluminum, the sample container is placed on a holder unit and the holder unit is set in an electric oven. Next, the holder unit is heated from 0 to 150° C. at a temperature increase rate of 10° C./min under a nitrogen atmosphere. Then, the holder unit is cooled from 150 to 0° C. at a temperature decrease rate of 10° C./min, and heated again to 150° C. at a temperature increase rate of 10° C./min, and a DCS curve is formed by differential scanning calorimeter DSC-60 from Shimadzu Corp.

From the DSC curve, a DSC curve in the first temperature increase is selected using an analysis program in the DSC-60 system to determine the endothermic shoulders (1') and (2') in the first temperature increase using "endothermic shoulder temperature" in the analysis program. Further, a DSC curve in the second temperature increase is selected using the "endothermic shoulder temperature" to determine the endothermic shoulders (1) and (2) in the second temperature increase.

The shoulder temperatures (1'), (1), (2') and (2) are defined to be higher in this order.

In addition, from the DSC curve, a DSC curve in the first temperature increase is selected using an analysis program in the DSC-60 system to determine the endothermic peak in the first temperature increase using "endothermic shoulder temperature" in the analysis program. Further, a DSC curve in the second temperature increase is selected using the "endothermic shoulder temperature" in the analysis program to determine the endothermic peak in the second temperature increase.

-Tg1st, Tg2nd and Qn Measurement Method-

First, about 5.0 mg of a toner is placed in a sample container made of aluminum, the sample container is placed on a holder unit and the holder unit is set in an electric oven. Next, the holder unit is heated from 20 to 150° C. at a temperature increase rate of 10° C./min under a nitrogen atmosphere. Then, the holder unit is cooled from 150 to 0° C. at a temperature decrease rate of 10° C./min, and heated again to 150° C. at a temperature increase rate of 10° C./min, and a DCS curve is formed by differential scanning calorimeter DSC-60 from Shimadzu Corp.

From the DSC curve, a shoulder of the DSC curve in the first temperature increase is selected using an analysis program in the DSC-60 system to determine Tg1st in the first temperature increase and an endothermic peak Qn in an area of from 50 to 120° C. Further, a shoulder of the DSC curve in the second temperature increase is selected using an analysis program in the DSC-60 system to determine Tg2nd in the second temperature increase.

-Tgr Measurement Method-

First, about 5.0 mg of a polyester resin is placed in a sample container made of aluminum, the sample container is placed on a holder unit and the holder unit is set in an electric oven. Next, the holder unit is heated from 20 to 150° C. at a temperature increase rate of 10° C./min under a nitrogen atmosphere. Then, the holder unit is cooled from 150 to 0° C. at a temperature decrease rate of 10° C./min, and heated again to 150° C. at a temperature increase rate of 10° C./min, and a DCS curve is formed by differential scanning calorimeter DSC-60 from Shimadzu Corp.

From the DSC curve, a shoulder of the DSC curve in the second temperature increase is selected using an analysis program in the DSC-60 system to determine a glass transition temperature Tgr of the polyester resin.

-Tgr' Measurement Method-

First, 0.5 mg of a fixing supplemental component and 4.5 mg of a polyester resin are placed in a sample container made of aluminum, the sample container is placed on a holder unit and the holder unit is set in an electric oven. Next, the holder unit is heated from 20 to 150° C. at a temperature increase rate of 10° C./min under a nitrogen atmosphere. Then, the holder unit is cooled from 150 to 0° C. at a temperature decrease rate of 10 ° C./min, and heated again to 150° C. at a temperature increase rate of 10° C./min, and a DCS curve is formed by differential scanning calorimeter DSC-60 from Shimadzu Corp.

From the DSC curve, a shoulder of the DSC curve in the second temperature increase is selected using an analysis program in the DSC-60 system to determine a glass transition temperature Tgr' of the polyester resin when the fixing supplemental component is added thereto.

The fixing supplemental component is not particularly limited as long as it satisfies the storage elastic modulus of the present invention. However, the following crystalline polyester resins, fatty acid amide compounds, ester compounds and diacid ester compounds are preferably used.

Specific examples of the crystalline polyester resins include those obtained by synthesizing alcoholic components such as saturated aliphatic diol compounds having 2 to 12 carbon atoms , particularly 1,4-butanediol, 1,6-hexanediol, 1,8-octanediol, 1,10-decanediol, 1,12-dodecanediol and their derivatives; and acidic components such as saturated dicarboxylic acids, particularly, fumaric acid, 1,4-butanediacid, 1,6-hexanediacid, 1,8-ocatnediacid, 1,10-decanediacid, 1,12-dodecanediacid and their derivatives.

Among these alcoholic components and acidic components, in terms of make a difference between an endothermic peak temperature and an endothermic shoulder temperature smaller, the crystalline polyester resin is preferably synthesized with only one of alcoholic components of 1,4-butanediol, 1,6-hexanediol, 1,8-octanediol, 1,10-decanediol, 1,12-dodecanediol and one of dicarboxylic acids of fumaric acid, 1,4-butanediacid, 1,6-hexanediacid, 1,8-ocatnediacid, 1,10-decanediacid, 1,12-dodecanediacid.

As a method of controlling crystallinity and softening point of the crystalline polyester resin, tri- or more polyols such as glycerin as an alcoholic component and tri- or more polycarboxylic acids such as trimellitic anhydride as an acidic component are polycondensated to prepare non-linear polyester.

The molecular structure of the crystalline polyester resin can be observed by X-ray diffraction, GC/MS, LC/MS, IR measurements, etc. besides NMR measurement with a solid or a liquid. Simple methods include an absorption based on δ CH (out-of-plane varying angle oscillation) of olefin at $965\pm10\ cm^{-1}$ or $990\pm10\ cm^{-1}$ in an infrared absorption spectrum.

As for the molecular weight of the polyester resin, when the molecular weight distribution is sharp and the molecular weight is low, the resultant toner has good low-temperature fixability. When too much low-molecular weight components are included in the polyester resin, the resultant toner deteriorates in thermostable storage stability. Therefore, the polyester resin preferably has a peak in a range of from 3.5 to 4.0 in an o-dichlorobenzene soluble GPC molecular-weight distribution in which the X-axis is log (M) and Y-axis is % by weight, and a peak half width not greater than 1.5, a weight-average molecular weight (Mw) of from 3,000 to 30,000, a number-average molecular weight (Mn) of from 1,000 to 10,000, and Mw/Mn of from 1 to 10. The polyester resin more preferably has a weight-average molecular weight (Mw) of from 5,000 to 15,000, a number-average molecular weight (Mn) of from 2, 000 to 10,000, and Mw/Mn of from 1 to 5.

In terms of affinity between a paper and a resin to obtain desired low-temperature fixability of the resultant toner, the crystalline polyester resin preferably has an acid value not less than 5 mg KOH/g, and more preferably not less than 10 mg KOH/g. In addition, the crystalline polyester resin preferably has an acid value not greater than 45 mg KOH/g to improve its hot offset resistance. Further, crystalline polyester resin preferably has a hydroxyl value of from 0 to 50 mg KOH/g, and more preferably from 5 to 50 mg KOH/g so that the resultant toner has desired low-temperature fixability and chargeability.

The crystalline polyester resin of the present invention preferably has an endothermic peak (T2-cp) not less than 60° C. and less than 80° C. when subjected to a second DSC heating, and the T2-cp preferably satisfies the following relationship:

$$(T2\text{-}cs2)-10<(T2\text{-}cp)<(T2\text{-}cs1)+10$$

wherein the T2-cs1 represents an endothermic shoulder temperature 1 and T2-cs2 represents an endothermic shoulder temperature 2 when the crystalline polyester is subjected to the second DSC heating.

The crystalline polyester resin of the present invention has a thermal property, i.e., rapid viscosity reduction at an endothermic peak temperature because of crystallinity. Namely, just before a melting point, the resin has good thermostable storage stability because of crystallinity, rapidly decreases viscosity at the melting point (sharp meltability) and fixes. Therefore, the resultant toner has both good thermostable storage stability and good low-temperature fixability.

When the crystalline polyester resin of the present invention preferably has an endothermic peak (T2-cp) not less than 60° C. and less than 80° C. (more preferably from 65 to 75° C.), the resultant toner can (further) improve its low-temperature fixability and thermostable storage stability at the same time.

When a difference between the endothermic shoulders 1 and 2, and the endothermic peak is small, the composition and the molecular weight variation in the crystalline polyester become small. Therefore, the crystalline polyester rapidly decreases viscosity at an endothermic peak temperature and the resultant toner improves in low-temperature fixability.

When a difference between the endothermic peak and an endothermic shoulder temperature 1 is less than 10° C. (6° C.), low-temperature property components in the crystalline polyester are decreased and the resultant toner (further) improves in thermostable storage stability and blocking resistance.

In addition, when a difference between the endothermic peak and an endothermic shoulder temperature 2 is less than 10° C. (6° C.), high-temperature property components in the crystalline polyester are decreased and the resultant toner (further) improves in low-temperature fixability.

The endothermic peak temperature can be controlled by a monomer constitution and a weight-average molecular weight of the crystalline polyester.

In order to make a difference of temperature between the endothermic shoulder temperature and the endothermic peak small, monomer constitutions increasing crystallinity of the crystalline polyester, specifically, acidic and alcoholic monomer constitutions are configured with more similar compounds to increase overlapping probability of the same constitution in a molecular chain. In addition, a difference between a number-average molecular weight and a weight-average molecular weight of the crystalline polyester is made small to make a difference of temperature between the endothermic shoulder temperature and the endothermic peak small. The number-average molecular weight and the weight-average molecular weight are controlled by reaction time and temperature when the crystalline polyester is polymerized. Specifically, a crystalline polyester is polymerized at higher temperature for longer time than conventional to make the difference between the number-average molecular weight and the weight-average molecular weight small. Further, a catalyst and an amount thereof used in polymerizing the crystalline polyester are capable of controlling the number-average molecular weight and the weight-average molecular weight as well.

The fatty acid amide preferably has a melting point of from 70 to 120° C. and has an amino group or a hydroxyl group at the terminal. Specific examples thereof include monoamide compounds, monoalcohol adduct amide compounds, bisalcohol adduct amide compounds, etc.

The monoamide compounds have the following formula (1):

$$R1\text{-}CONH_2 \quad (1)$$

wherein R1 is a saturated, or a mono or bivalent unsaturated hydrocarbon group having 10 to 30 carbon atoms.

The monoalcohol adduct amide compounds have the following formula (2):

$$R1\text{-}NHCO\text{—}R2\text{-}OH \quad (2)$$

wherein R1 is a saturated, or a mono or bivalent unsaturated hydrocarbon group having 10 to 30 carbon atoms; and R2 is a saturated, or a mono or bivalent unsaturated hydrocarbon group having 1 to 30 carbon atoms.

The bisalcohol adduct amide compounds have the following formula (3):

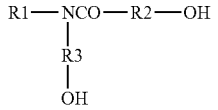

(3)

wherein R1 is a saturated, or a mono or bivalent unsaturated hydrocarbon group having 10 to 30 carbon atoms; R2 is a saturated, or a mono or bivalent unsaturated hydrocarbon group having 1 to 30 carbon atoms; and R3 is a saturated, or a mono or bivalent unsaturated hydrocarbon group having 1 to 30 carbon atoms.

The monoamide compounds, monoalcohol adduct amide compounds and bisalcohol adduct amide compounds including highly-polar amino groups (—NH2) and hydroxyl groups (—OH) at their fatty acid terminals have good compatibility with a resin which is a main component of a toner. They quickly melt and softens a binder resin to improve low-temperature of a toner. The monoamide compounds are more preferably used because of having good compatibility with a resin and improving low-temperature of a toner more.

The fatty acid amide preferably has a melting point of from 70 to 120° C., more preferably from 75 to 100° C., and furthermore preferably from 75 to 95° C. When lower than 70° C., the resultant toner occasionally deteriorates in thermostable storage stability. When higher than 120° C., the resultant toner occasionally does not have sufficient low-temperature fixability.

Specific examples of the fatty acid amide having a melting point of from 70 to 120° C. include, but are not limited to, palmitic amide, palmitic amide, palmitoleic amide, stearic amide, oleic amide, arachidic amide, eicosanoic amide, behenic amide, erucic amide, monoamide compounds which are amidated and saturated or monohydric unsaturated fatty series having 10 to 30 carbon atoms such as lignoceric amide, and alcohol adducts of fatty acid amide such as palmitic monoethanol amide, stearic monoethanol amide, behenic monoethanol amide, lignoceric monoethanol amide, erucic monoethanol amide, palmitic monopropanol amide, stearic monopropanol amide, behenic monopropanol amide, lignoceric monopropanol amide, erucic monopropanol amide, palmitic bisethanol amide, stearic bisethanol amide, behenic bisethanol amide, lignoceric bisethanol amide, erucic bisethanol amide, palmitic bispropanol amide, stearic bispropanol amide, behenic bispropanol amide, lignoceric bispropanol amide, erucic bispropanol amide, ethanolamine distearate, ethanolamine dibehenate, ethanolamine dilignocerate, ethanolamine dierucate, propanolamine distearate, propanolamine dibehenate, propanolamine dilignocerate and propanolamine dierucate. Particularly, monoamide compounds or alcohol adducts thereof are preferably used because of having good compatibility with a resin, improving low-temperature fixability of a toner, and not deteriorating thermostable storage stability thereof.

It is preferable that the fixing supplemental component of the present invention is an ester compound having a melting point not less than 60° C. and less than 85° C. and a hydroxyl value not less than 10 mg KOH/g and less than 100 mg KOH/g, and includes ethylene glycol in an amount not less than 80% by weight as an alcohol component and a stearic acid and/or a behenic acid in an amount not less than 80% by weight as a fatty acid component.

Ethylene glycol having good sharp-meltability quickly melts when heated and softens a binder resin, and therefore the resultant toner has low-temperature fixability.

The stearic acid and/or the behenic acid improves crytallinity of the ester compound, and therefore the ester compound has good sharp-meltability, which quickly melts when heated and softens a binder resin, and therefore the resultant toner has low-temperature fixability.

The alcohol component includes polyol monomers such as propylene glycol, butylene glycol, tetramethylene glycol and glycerin, or condensed and polymerized polyols besides ethylene glycol. The condensed and polymerized polyols preferably has a polymerization degree not less than 2 and less than 20. When not less than 20, the fixing supplemental component deteriorates in crystallinity and loses sharp-meltability, and therefore the resultant toner occasionally does not have sufficient low-temperature fixability.

The fatty acid includes fatty acids having 12 to 24 carbon atoms or their mixtures besides a stearic acid and a behenic acid. Specific examples thereof include a lauric acid, a palmitic acid, an arachidic acid, an eicosanoic acid, lignoceric or their mixtures. When the carbon atoms is less than 12, the fixing supplemental component deteriorates in crystallinity and lowers its melting point, and therefore the resultant toner occasionally does not have sufficient thermostable storage stability. In addition, the fixing supplemental component deteriorates loses sharp-meltability, and therefore the resultant toner occasionally does not have sufficient low-temperature fixability.

The ester compound softens a binder resin which is a main component of a toner so that the toner have low-temperature fixability. Therefore, the ester compound preferably has a certain amount of hydroxyl value.

The ester compound preferably has a hydroxyl value not less than 10 mg KOH/g and less than 100 mg KOH/g. When less than 10 mg KOH/g, the ester compound is not fully compatible with a binder resin, and therefore the resultant toner occasionally does not have sufficient low-temperature fixability. When not less than 100 mg KOH/g, the resultant toner possibly deteriorates in chargeability at high temperature and high humidity.

The hydroxyl value is an amount of potassium hydroxide needed to neutralize ethylacetate combined with a hydroxyl group when 1 g of a sample is acetylated under the following conditions. A method of measuring the hydroxyl value will be explained.

First, precisely-weighed 1 g of a sample is placed in a round flask, and precisely-measured 5 ml of an acetic anhydride pyridine solution is added in the flask. A small funnel is placed on an opening of the flask, and a bottom thereof is dipped in an oil bath having a temperature of from 95 to 100° C. at a depth about 1 cm to heat the flask for 1 hr. Next, the flask is cooled and 1 ml of water is added therein, and the flaks is shook well and further heated for 10 min. Further, after the flask is cooled, the small funnel and a neck of the flask are washed with 5 ml of ethanol. 1 ml of a phenolphthalein solution as an indicator is added in the flask, and an excessive amount of ethylacetate is titrated with 0.5 mol/l of an ethanol solution of potassium hydroxide (true test). A blank test is performed as above except for not placing a sample, and a hydroxyl value is determined by the following formula:

$$\text{hydroxyl value}=((a[\text{ml}]-b[\text{ml}])\times 28.05/\text{collection qty. of sample [g]}+\text{acid value}$$

wherein a and b are titration amounts of 0.5 mol/l of an ethanol solution of potassium hydroxide in blank and true tests, respectively.

The acid value is an amount of potassium hydroxide needed to neutralize 1 g of a sample. A method of measuring the acid value will be explained.

First, precisely-weighed 1.0 g of a sample is dissolved in 50 ml of an ethanol/ether mixed liquid (volume ratio 1:1) upon application of heat when necessary to prepare a sample liquid. Next, after the sample liquid is cooled, a few drops of phenolphthalein test solution are added thereto. The sample liquid is titrated with 0.1 mol/l of an ethanol solution of potassium hydroxide until having a red color continuing for 30 sec, and the acid value is determined by the following formula:

$$\text{acid value } \mathbf{32}\ c[\text{ml}]\times 5.611/\text{collection qty. of sample [g]}$$

wherein c is a titration amount of 0.1 mol/l of an ethanol solution of potassium hydroxide.

The ester compound in the present invention preferably has a melting point not less than 60° C. and less than 85° C. When less than 60° C., the resultant toner deteriorates in thermostable storage stability. When greater than 85° C., the resultant toner deteriorates in low-temperature fixability. The melting point is a temperature at which an endothermic quantity is maximum in a differential heat curve obtained by differential scanning calorimetric (DSC) analysis.

In the present invention, when the fixing supplemental component is a dibasic ester compound, the dibasic ester compound is preferably formed by esterifying a dicarboxylic acid and a monohydric aliphatic alcohol. It is preferable that the dicarboxylic acid has 2 to 6 carbon atoms and the dibasic ester compound has a melting point of from 60 to 100° C. Specific examples of the dicarboxylic acid include fumaric acids having the following formula:

$$\text{HOOC—}(\text{CH}_2)_n\text{—COOH}$$

wherein n represents 0 or an integer of from 1 to 4.

Specific examples of the monohydric aliphatic alcohol include alcohols having the following formula:

$$\text{R1-OH}$$

wherein R1 represents a saturated or an unsaturated hydrocarbon group.

Specific examples of the dibasic ester compound include compounds having the following formulae:

$$\text{R2-COO-R1-COO-R3}$$

$$\text{R2-COO-R1-COOH}$$

wherein R1 represents a straight-chain hydrocarbon group having 0 to 4 carbon atoms; R2 represents a saturated or an unsaturated hydrocarbon group; and R3 represents a saturated or an unsaturated hydrocarbon group. The dibasic ester compound more preferably has a melting point of from 75 to 100° C., and furthermore preferably from 75 to 95° C. When less than 60° C., the resultant toner deteriorates in thermostable storage stability. When greater than 100° C., the resultant toner does not have sufficient low-temperature fixability. The dicarboxylic acid may be esterified with plural monohydric aliphatic alcohols. The dibasic ester compound may be diester, monoester or their mixture.

The dibasic ester compound including an ester group and a carboxyl group as polar groups has good compatibility with a polyester resin which is a main component of a toner and quickly melts when heated and softens a binder resin, and therefore the resultant toner has low-temperature fixability.

The carboxylic acid having 2 to 6 carbon atoms and the monohydric aliphatic alcohol improve sharp-meltability of the dibasic ester compound, which quickly melts when heated and softens a binder resin, and therefore the resultant toner has low-temperature fixability.

The dicarboxylic acid is preferably an adipic acid or a fumaric acid, and more preferably an adipic acid. The adipic acid and the fumaric acid having 4 and 6 carbon atoms, respectively have good compatibility with a polyester resin which is a main component of a toner and quickly melt when heated and soften a binder resin, and therefore the resultant toner has low-temperature fixability.

The dicarboxylic acid having 2 to 6 carbon atoms and the straight-chain aliphatic alcohol improves crystallinity of the dibasic ester compound, and therefore the resultant toner has good thermostable storage stability, is tough against stress when stirred in an image developer, and produces high-definition images for long periods.

The straight-chain aliphatic alcohol is preferably a saturated aliphatic alcohol, and more preferably has 10 to 24 carbon atoms. The saturated aliphatic alcohol improves crystallinity of the dibasic ester compound, and therefore the resultant toner has good thermostable storage stability, is tough against stress when stirred in an image developer, and produces high-definition images for long periods.

When the carbon atoms is less than 10, the dibasic ester compound deteriorates in crystallinity, and the resultant toner occasionally deteriorates in thermostable storage stability. When greater than 24, the dibasic ester compound deteriorates in compatibility with a binder resin, and the resultant toner occasionally deteriorates in low-temperature fixability. The dibasic ester compound preferably has an acid value not less than 0.1 mg KOH/g and less than 100 mg KOH/g. When less than 0.1 mg KOH/g, the dibasic ester compound does not have sufficient compatibility with a binder resin, and the resultant toner occasionally does not have sufficient low-temperature fixability. When not less than 100 mg KOH/g, the resultant toner possibly deteriorates in chargeability at high temperature and high humidity.

The acid value is specifically decided by the following procedure.

Measurer: Potentiometric Automatic Titrator DL-53 Titrator from Metler-Toledo Limited Electrode: DG113-SC from Metier-Toledo Limited Analysis software: LabX Light Version 1.00.000

Temperature: 23° C.

The Measurement Conditions are as Follows:

Stir
Speed [%] 25
Time [s] 15
EQP titration
Titrant/Sensor
Titrant $CH_3$0Na
Concentration[mol/L]0.1
Sensor DG115
Unit of measurement mV
Predispensing to Volume
Volume [ml] 1.0
Wait time [s] 0
Titrant Addition Dynamic
dE(set) [mV] 8.0
dV(min) [mL] 0.03
dV(max) [mL] 0.5
Measure Mode Equilibrium Controlled
dE [my] 0.5
dt [s] 1.0
t(min) [s] 2.0
t(max) [s] 20.0
Recognition
Threshold 100.0
Steepest jump only No
Range No
Tendency None
Termination
at maximum volume [mL] 10.0
at potential No
at slope No
after number EQPs Yes
n=1
comb. Termination conditions No
Evaluation
Procedure Standard
Potential 1 No
Potential 2 No
Step for reevaluation No The acid value is specifically measured by the method mentioned in JIS K0070-1992. First, 0.5 g of polyester is stirred in 120 ml of toluene at a room temperature (23° C.) for 10 hrs to be dissolved therein, and 30 ml of ethanol is further added thereto to prepare a sample solution. Next, a 0.1N potassium-alcohl solution, the concentration of which is previously specified, is titrated in the sample solution to determine a titrated amount thereof X [ml] and the acid value is determined by the following formula:

$$\text{Acid value}=X\,(\text{ml})\times N\times 56.1/\text{weight of the sample solution}$$

wherein N is the 0.1N caustic potassium-alcohl solution factor.

In the present invention, the binder resin include a polyester resin because the resultant toner has good low-temperature. The polyester resin may have a molecular weight and constitutional monomers in accordance with purposes. The binder resin may further include resins other than the polyester resin. Specific examples thereof include polymers or copolymers of styrene monomers, acrylic monomers methacrylic monomers, etc.; polyol resins; phenol resins; silicone resins; polyurethane resins; polyamide resins; furan resins; epoxy resins; xylene resins; terpene resins; coumarone-indene resins; polycarbonate resins; petroleum resins; etc. These can be used alone or in combination.

The polyester resins are not particularly limited, and can be prepared by dehydrating and condensing polyols and polycarboxylic acids. Specific examples of the polyols include diols such as ethylene glycol, propylene glycol, 1,3-butanediol, 1,4-butanediol, 2,3-butanediol, diethylene glycol, triethylene glycol, 1,5-pentanediol, 1,6-hexanediol, neo-pentyl glycol, 2-ethyl-1,3-hexanediol, hydrogenated bisphenol A ethyleneoxide modified bisphenol A and propyleneoxide modified bisphenol A. In order to crosslink polyester resins, tri- or more valent alcohols such as sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, 1,3,5-trihydroxybenzene, etc. are preferably combined with the diols.

Specific examples of dicarboxylic acids in the polycarboxylic acids include benzene dicarboxylic acids such as a phthalic acid, an isophthalic acid and a terephthalic acid or their anhydrides; alkyl dicarboxylic acids such as a succinic acid, an adipic acid, a sebacic acid and an azelaic acid or their anhydrides; unsaturated diacids such as a maleic acid, a citraconic acid, an itaconic acid, an alkenyl succinic acid, a fumaric acid and a mesaconic acid; unsaturated diacid anhydrides such as a maleic acid anhydride, citraconic acid anhydride, an itaconic acid anhydride and an alkenyl succinic acid anhydride; a trimellitic acid, pyromellitic acid, a 1,2,4-benzenetricarboxylic acid, a 2,5,7-naphthalenetricarboxylic acid, a 1,2,4-naphthalenetricarboxylic acid, a 1,2,4-butanetricarboxylic acid, a 1,2,5-hexanetricarboxylic acid, 1,3-dicarboxyl-2-methyl-methylenecarboxypropane, tetra (methylenecarboxyl)methane, a 1,2,7,8-octantetracarboxylic acid, an empol trimer acid, and their anhydrides and partially lower alkyl esters, etc.

The polyester resin preferably has an acid value of from 5 to 40 mg KOH/g, and more preferably from 10 to 30 mg KOH/g. When less than 5 mg KOH/g, the resultant toner deteriorates in affinity with papers which are main recording media, low-temperature fixability and negative chargeability, resulting in occasional production of deteriorated images. In addition, the polyester resin occasionally deteriorates in compatibility with the dibasic ester compound which is a fixing supplemental component in the present invention, and therefore the resultant toner possibly does not have sufficient low-temperature fixability. When greater than 40 mg KOH/g, the resultant toner deteriorates in environment resistance against high (low) temperature and high (low) humidity, resulting in occasional production of deteriorated images.

The polyester resin preferably has a hydroxyl value of from 5 to 100 mg KOH/g, and more preferably from 20 to 60 mg KOH/g. When less than 5 mg KOH/g, the resultant toner deteriorates in affinity with papers which are main recording media, low-temperature fixability and negative chargeability, resulting in occasional production of deteriorated images. In addition, the polyester resin occasionally deteriorates in compatibility with the dibasic ester compound which is a fixing supplemental component in the present invention, and therefore the resultant toner possibly does not have sufficient low-temperature fixability. When greater than 100 mg KOH/g, the resultant toner deteriorates in environment resistance against high (low) temperature and high (low) humidity, resulting in occasional production of deteriorated images.

The polyester resin preferably includes elements soluble with tetrahydrofuran (THF), having at least one peak in a range of 3,000 to 50,000, and more preferably from 5,000 to 20,000 in a molecular weight distribution by GPC thereof in terms of the fixability and offset resistance of the resultant toner. In addition, the THF-soluble elements having a molecular weight not greater than 100,000 is preferably from 60 to 100% by weight based on total weight of the THF-soluble elements. The polyester resin preferably has a glass transition temperature (Tg) of from 55 to 80° C., and more preferably from 60 to 75° C. in terms of the storage stability of the resultant toner. When the Tg is from 55 to 80° C., the resultant toner has good stability when stored at high temperature and good low-temperature fixability.

The release agent for use in the present invention is not particularly limited and can be selected in accordance with the purpose, and preferably has a melting point of from 60 to 90° C. A wax having a low melting point is effectively used as a release agent. When such a wax is included in the toner, the wax is dispersed in the binder resin and serves as a release agent at a location between a fixing roller and the toner particles. Thereby, hot offset resistance can be improved without applying an oil to the fixing roller used. Particularly in the present invention, the release agent needs to exert releasability at lower temperature because a fixing roller is used at lower temperature since the fixing supplemental component is used to fix a toner at low temperature. Therefore, a release agent having a melting point not higher than 90° C. is preferably used. When lower than 60° C., the resultant toner occasionally deteriorates in high-temperature storage stability and possibly produces deteriorated images.

Specific examples of the release agent include natural waxes such as vegetable waxes, e.g., carnauba wax, cotton wax, Japan wax and rice wax; animal waxes, e.g., bees wax and lanolin; mineral waxes, e.g., ozokelite and ceresine; and petroleum waxes, e.g., paraffin waxes, microcrystalline waxes and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes and ether waxes. These can be used alone or in combination.

Particularly in the present invention, hydrocarbon waxes such as paraffin waxes, polyethylene waxes, microcrystalline waxes and polypropylene waxes are preferably used. The hydrocarbon waxes have low compatibility with fatty acid amide compounds which are fixing supplemental components of the present invention and they work independently without impairing capabilities of each other, and therefore the resultant toner has sufficient low-temperature fixability.

Specific examples of the colorants for use in the present invention include any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium-oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The toner preferably includes the colorant in an amount of from 1 to 15% by weight, and more preferably from 3 to 10% by weight. When less than 1% by weight, the resultant toner occasionally deteriorates in colorability. When greater than 15% by weight, the pigment is not well dispersed in a toner, resulting in occasional deterioration of colorability and electrical properties of the resultant toner.

The colorant may be used as a masterbatch pigment combined with a resin. Specific examples of the resin include, but are not limited to, styrene polymers or substituted styrene polymers, styrene copolymers, a polymethyl methacrylate resin, a polybutylmethacrylate resin, a polyvinyl chloride resin, a polyvinyl acetate resin, a polyethylene resin, a polypropylene resin, a polyester resin, an epoxy resin, an epoxy polyol resin, a polyurethane resin, a polyamide resin, a polyvinyl butyral resin, an acrylic resin, rosin, modified rosins, a terpene resin, an aliphatic or an alicyclic hydrocarbon resin, an aromatic petroleum resin, chlorinated paraffin, paraffin waxes, etc. These resins are used alone or in combination.

Specific examples of the styrene polymers or substituted styrene polymers include polyester resins, polystyrene resins, poly-p-chlorostyrene resins and polyvinyltoluene resins. Specific examples of the styrene copolymers include styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butylacrylate copolymers, styrene-octylacrylate copolymers, styrene-methyl methacrylate copolymers, styrene-ethyl methacrylate copolymers, styrene-butyl methacrylate copolymers, styrene-α-chloro methyl methacrylate copolymers, styrene-acrylonitrile copolymers, styrene-vinyl methyl ketone copolymers, styrene-butadiene copolymers, styrene-isoprene copolymers, styrene-acrylonitrile indene copolymers, styrene-maleate copolymers, styrene maleic acid ester copolymers, etc.

The masterbatch for use in the toner of the present invention is typically prepared by mixing and kneading a resin and a colorant upon application of high shear stress thereto. In this case, an organic solvent can be used to heighten the interaction of the colorant with the resin. In addition, flushing methods in which an aqueous paste including a colorant is mixed with a resin solution of an organic solvent to transfer the colorant to the resin solution and then the aqueous liquid and organic solvent are separated and removed can be preferably used because the resultant wet cake of the colorant can be used as it is. Of course, a dry powder which is prepared by drying the wet cake can also be used as a colorant. In this case, a three-roll mill is preferably used for kneading the mixture upon application of high shear stress.

The toner may include other components such as a charge controlling agent, an inorganic particulate material, a cleanability improver and a magnetic material.

Specific examples of the charge controlling agent include known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc. These can be used alone or in combination.

Specific examples of the marketed products of the charge controlling agents include BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

The toner preferably includes the charge controlling agent in an amount of from 0.1 to 10 parts by weight, and more preferably from 0.2 to 5 parts by weight, based on total weight of the binder resin included in the toner. When less than 0.1 parts by weight, the toner occasionally does not have charge controllability. When greater than 10 parts by weight, the toner has too large charge quantity, and thereby the electrostatic force of a developing roller attracting the toner increases, resulting in deterioration of the fluidity of the toner and decrease of the image density of toner images.

The inorganic particulate material is used as an external additive imparting fluidity, developability and chargeability to a toner. Specific examples thereof include silica, alumina, titanium oxide, barium titanate, magnesium titanate, calcium titanate, strontium titanate, zinc oxide, tinoxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc. These can be used alone or in combination.

The inorganic particulate materials preferably have a primary particle diameter of from 5 nm to 2 μm, and more preferably from 5 nm to 500 nm.

The toner preferably includes the inorganic particulate material in an amount of from 0.01 to 5.0% by weight, and more preferably from 0.01 to 2.0% by weight, based on total weight of the toner.

The inorganic particulate material is preferably surface-treated with a fluidity improver to improve hydrophobicity thereof and prevents deterioration of fluidity and chargeability thereof.

Specific examples of the fluidity improver include silane coupling agents, sililating agents, silane coupling agents having an alkyl fluoride group, organic titanate coupling agents, aluminium coupling agents silicone oils and modified silicone oils. Silica and titanium oxide are preferably used as hydrophobic silica and titanium oxide after surface-treated with the fluidity improver.

The cleanability improver is used to easily remove a toner remaining on a photoreceptor and a first transferer after transferred. Specific examples thereof include fatty acid metallic salts such as zinc stearate, calcium stearate and stearic acid; and particulate polymers prepared by a soap-free emulsifying polymerization method such as particulate polymethylmethacrylate and particulate polystyrene. The particulate polymers comparatively have a narrow particle diameter distribution and preferably have a volume-average particle diameter of from 0.01 to 1 μm.

Specific examples of the magnetic material include iron powder, magnetite, ferrite, etc. The magnetic material is preferably white in color in terms of color tone of a toner.

The toner of the present invent ion has good low-temperature fixability and offset resistance, and produces high-quality images for long periods.

Therefore, the toner of the present invention can be used in various fields, and preferably used in electrophotographic image formation.

Methods of preparing the toner are not particularly limited, and known methods such as kneading & pulverization methods; polymerization methods (suspension polymerization methods and emulsion polymerization methods); solution suspension methods; and spray granulation methods can be used. The polymerization methods and the solution suspension methods granulating in an aqueous medium are preferably used because of easily forming incompatibility between the fixing supplemental component and the polyester resin when preparing a toner.

The kneading & pulverization methods and the solution suspension methods will be explained.

The kneading & pulverization methods include melting, kneading, pulverizing and classifying toner constituents to form a parent toner.

In the kneading process after mixing toner constituents to prepare a mixture, the mixture is contained in a kneader and then kneaded upon application of heat. Suitable kneaders include the kneaders include single-axis or double-axis continuous kneaders and batch kneaders such as roll mills. Specific examples of the kneaders include KTK double-axis extruders manufactured by Kobe Steel, Ltd., TEM extruders manufactured by Toshiba Machine Co., Ltd., double-axis extruders manufactured by KCK Co., Ltd., PCM double-axis extruders manufactured by Ikegai Corp., and KO-KNEADER manufactured by Buss AG. In the kneading process, it is preferable to control the kneading conditions so as not to cut molecular chains of the binder resin in the toner. Specifically, when the mixture is kneaded at a temperature too lower than a softening point of the binder resin, the molecular chains of the binder resin tend to cut. When the kneading temperature is too high, the mixture cannot be fully dispersed.

In the pulverizing process, it is preferable that the kneaded mixture is at first crushed to prepare coarse particles (crushing step) and then the coarse particles are pulverized to prepare fine particles (pulverizing step). In the pulverizing step, a method of crashing the coarse particles against a collision plate by jet air or a method of passing the coarse particles through a narrow gap between a mechanically rotating rotor and a stator is preferably used.

In the classifying process, the pulverized mixture is classified into particles having a predetermined particle diameter. The classification is made by cyclone, decanter and centrifugal separation, etc. to remove microscopic particles.

After the microscopic particles are removed, pulverized mixture is further air-classified by a centrifugal force to prepare a parent toner having a predetermined particle diameter.

Next, an external additive is externally added to the parent toner. The parent toner and the external additive are mixed and stirred in a mixer, in which the external additive is coated on the surface of the parent toner while pulverized. Then, it is important to uniformly and firmly attach an external additive such as an inorganic particulate material and a particulate resin to the parent toner in terms of durability of the resultant toner.

The toner is preferably prepared by dissolving or dispersing toner constituents including at least an active-hydrogen-group-containing compound and a polymer reactable therewith in a solvent to prepare a solution or a dispersion; and emulsifying or dispersing the solution or the dispersion in an aqueous medium so that the active-hydrogen-group-containing compound is reacted with the polymer reactable therewith to form a particulate material including at least an adhesive base material therein.

The solution or the dispersion is prepared by dissolving or dispersing the toner constituents in a solvent. The toner constituents are not particularly limited as long as they are capable of forming a toner and can be selected as desired in accordance with purposes, and include, e.g., at least a binder resin, a fixing supplemental component and a colorant; preferably an active-hydrogen-group-containing compound and a polymer (prepolymer) reactable therewith and a wax; and other components such as a charge controlling agent.

The toner is preferably prepared by dissolving or dispersing toner constituents such as an active-hydrogen-group-containing compound, a polymer reactable therewith, a fixing supplemental component, a wax, a colorant and a charge controlling agent to prepare a solution or a dispersion. The toner constituents besides the active-hydrogen-group-containing compound and the polymer (prepolymer) reactable therewith may be added and mixed in an aqueous medium mentioned later or added therein together with the solution or the dispersion.

The active-hydrogen-group-containing compound acts as an elongator or a crosslinker when the polymer reactable with the active-hydrogen-group-containing compound is elongated or crosslinked.

The active-hydrogen-group-containing compound is not particularly limited as long as it has an active hydrogen group, and can be selected in accordance with the purpose. For example, when the polymer reactable with the active-hydrogen-group-containing compound is a polyester prepolymer including an isocyanate group (A), amines (B) are preferably used because of being polymerizable when subjected to an elongation or crosslinking reaction with the polyester prepolymer including an isocyanate group (A).

The active hydrogen group is not particularly limited and can be selected in accordance with the purpose. Specific examples thereof include hydroxyl groups (alcoholic or phenolic hydroxyl groups), amino groups, carboxyl groups, mercapto groups, etc. These can be used alone or in combination. Among these, the alcoholic hydroxyl groups are preferably used.

The amines (B) are not particularly limited and can be selected in accordance with the purpose. Specific examples thereof include diamines (B1), polyamines (B2) having three or more amino groups, amino alcohols (B3), amino mercaptans (B4), amino acids (B5) and blocked amines (B6) in which the amines (B1-35) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoronediamine); aliphatic diamines (e.g., ethylene diamine, tetramethylene diamine and hexamethylene diamine); etc.

Specific examples of the polyamines (B2) having three or more amino groups include diethylene triamine, triethylene tetramine.

Specific examples of the amino alcohols (B3) include ethanol amine and hydroxyethyl aniline.

Specific examples of the amino mercaptan (B4) include aminoethyl mercaptan and aminopropyl mercaptan.

Specific examples of the amino acids (B5) include amino propionic acid and amino caproic acid.

Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc.

A reaction terminator can be used to terminate the elongation or crosslinking reaction between the active-hydrogen-group-containing compound and the polymer reactable therewith. The reaction terminator is preferably used to control the molecular weight of the adhesive base material. Specific examples of the reaction terminator include monoamines such as diethyle amine, dibutyl amine, butyl amine and lauryl amine, and blocked amines, i.e., ketimine compounds prepared by blocking the monoamines mentioned above.

The mixing ratio (i.e., a ratio [NCO]/[NHx]) of the content of the prepolymer (A) having an isocyanate group to the amine (B) is from 1/2 to 2/1, preferably from 1.5/1 to 1/1.5 and more preferably from 1.2/1 to 1/1.2.

The polymer reactable with the active-hydrogen-group-containing compound (hereinafter referred to as a "prepolymer") is not particularly limited as long as it has a site reactable with the active-hydrogen-group-containing compound, and can be selected from known resins, etc. Specific examples thereof include a polyol resins, a polyacrylic resin, a polyester resin, an epoxy resin, their derivatives, etc. These can be used alone or in combination. Among these resins, the polyester resin having high fluidity when melting and transparency is preferably used.

The site reactable with the active-hydrogen-group-containing compound is not particularly limited, and can be selected from known substituents, etc. Specific examples thereof include an isocyanate group, an epoxy group, a carboxylic acid group, an acid chloride group, etc. These can be used alone or in combination. Among these groups, the isocyanate group is preferably used.

Among the prepolymers, a polyester resin including a group formed by urea bonding (RMPE) is preferably used because of being capable of controlling the molecular weight of the polymer components, imparting oilless low-temperature fixability to a dry toner, and good releasability and fixability thereto even in an apparatus without a release oil applicator to a heating medium for fixing.

The group formed by urea bonding includes an isocyanate group, etc. When the group formed by urea bonding of the polyester resin including a group formed by urea bonding (RMPE) is an isocyanate group, the polyester prepolymer including an isocyanate group (A) is preferably used as the polyester resin including a group formed by urea bonding (RMPE).

The polyester prepolymer including an isocyanate group (A) is not particularly limited, and can be selected in accordance with the purpose. For example, the polyester prepolymers including an isocyanate group (A) can be prepared by reacting a polycondensation product of a polyol (PO) and a polycarboxylic acid (PC), i.e., a polyester resin having a group including an active hydrogen atom, with a polyisocyanate (PIC).

The polyol (PO) is not particularly limited, and can be selected in accordance with the purpose. For example, suitable polyols (PO) include diols (DIO), polyols (TO) having three or more hydroxyl groups, and mixtures of DIO and TO. These can be used alone or in combination. Preferably, diols (DIO) alone or mixtures of a diol (DIO) with a small amount of polyol (TO) are used.

Specific examples of the diol (DIO) include alkylene glycols, alkylene ether glycols, alicyclic diols, bisphenols, alkylene oxide adducts of alicyclic diols, alkylene oxide adducts of bisphenols, etc.

Specific examples of the alkylene glycols include ethylene glycol, 1,2-propylene glycol, 1,3-propylene glycol, 1,4-butanediol and 1,6-hexanediol. Specific examples of the alkylene ether glycols include diethylene glycol, triethylene glycol, dipropylene glycol, polyethylene glycol, polypropylene glycol and polytetramethylene ether glycol. Specific examples of the alicyclic diols include 1,4-cyclohexanedimethanol and hydrogenated bisphenol A. Specific examples of the bisphenols include bisphenol A, bisphenol F and bisphenol S. Specific examples of the alkylene oxide adducts of alicyclic diols include adducts of the alicyclic diols mentioned above with an alkylene oxide (e.g., ethylene oxide, propylene oxide and butylene oxide). Specific examples of the alkylene oxide adducts of bisphenols include adducts of the bisphenols mentioned above with an alkylene oxide (e.g., ethylene oxide, propylene oxide and butylene oxide).

Among these compounds, alkylene glycols having from 2 to 12 carbon atoms and adducts of bisphenols with an alkylene oxide are preferable. More preferably, adducts of bisphenols with an alkylene oxide, and mixtures of an adduct of bisphenols with an alkylene oxide and an alkylene glycol having from 2 to 12 carbon atoms are used.

Specific examples of the TO include multivalent aliphatic alcohol having 3 to 8 or more valences such as glycerin, trimethylolethane, trimethylolpropane, pentaerythritol and sorbitol; phenol having 3 or more valences such as trisphenol PA, phenolnovolak, cresolnovolak; and adducts of the above-mentioned polyphenol having 3 or more valences with an alkylene oxide such as ethylene oxide, propylene oxide and butylene oxide.

A mixing ratio (DIO/TO) of the DIO to the TO is preferably 100/0.01 to 10, and more preferably 100/0.01 to 1.

Specific examples of the polycarboxylic acids (PC) include dicarboxylic acids (DIC) and polycarboxylic acids having three or more carboxyl groups (TC). These can be used alone or in combination. The dicarboxylic acids (DIC) alone and a mixture of the dicarboxylic acids (DIC) and a small amount of the polycarboxylic acid having three or more carboxyl groups (TC) are preferably used.

Specific examples of the dicarboxylic acids (DIC) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acid having three or more (preferably from 3 to 8) hydroxyl groups (TO) include aromatic polycarboxylic acids having from 9 to 20 carbon atoms (e.g., trimellitic acid and pyromellitic acid).

Anhydrides or lower alkyl esters (e.g., methyl esters, ethyl esters or isopropyl esters) of the dicarboxylic acids (DIC), the polycarboxylic acids having three or more hydroxyl groups (TC) or their mixture can also be used as the polycarboxylic acid (PC). Specific examples of the lower alkyl esters include a methyl ester, an ethyl ester, an isopropyl ester, etc.

A mixing ratio (DIC/TC) of the DIC to the TC is preferably from 100/0.01 to 10, and more preferably from 100/0.01 to 1.

Suitable mixing ratio (i.e., the equivalence ratio [OH]/[COOH]) of the [OH] group of a polyol (PO) to the [COOH] group of a polycarboxylic acid (PC) is from 2/1 to 1/1, preferably from 1.5/1 to 1/1 and more preferably from 1.3/1 to 1.02/1.

The polyester prepolymer including an isocyanate group (A) preferably includes the polyol (PO) in an amount of from 0.5 to 40% by weight, more preferably from 1 to 30% by weight, and furthermore preferably from 2 to 20% by weight. When less than 0.5% by weight, the hot offset resistance of the resultant toner deteriorates, which is difficult to have both thermostable preservability and low-temperature fixability. When greater than 40% by weight, the low-temperature fixability thereof deteriorates.

The polyisocyanate (PIC) is not particularly limited and can be selected in accordance with the purpose. Specific examples thereof include aliphatic polyisocyanates such as tetramethylenediisocyanate, hexamethylenediisocyanate, 2,6-diisocyanatemethylcaproate, octamethylenediisocyanate, decamethylenediisocyanate, dodecamethylenediisocyanate, tetradecamethylenediisocyanate and trimethylhexanediisocyanate; alicyclic polyisocyanates such as isophoronediisocyanate and cyclohexylmethanediisocyanate; aromatic diisocianates such as tolylene diisocyanate, diphenylmethane diisocyanate, 1,5-naphthylene diisocyanate, diphenylene-4,4'-diisocyanate, 4,4'-diisocyanate-3,3-dimethyl diphenyl, 3-methyldiphenylmethane-4,4'-diisocynate and diphenylether-4,4'-diisocyanate; aromatic aliphatic diisocyanates such as α, α, α', α'-tetramethylxylylenediisocyanate; isocyanurates such as tris-isocyanatealkyl-isocyanurate and triisocyanatecycloalkyl-isocyanurate; blocked polyisocyanates in which the polyisocyanates mentioned above are blocked with phenol derivatives, oximes or caprolactams; etc. These compounds can be used alone or in combination.

Suitable mixing ratio (i.e., the equivalence ratio [NCO]/OH]) of the [NCO] group of the polyisocyanate (PIC) to the [OH] group of the polyester resin having a group including an active hydrogen (such as a polyester resin including a hydroxyl group) is from 5/1 to 1/1, preferably from 4/1 to 1.2/1 and more preferably from 2.5/1 to 1.5/1.

When greater than 5/1, the low-temperature fixability of the resultant toner deteriorates. When less than1/1 , the offset resistance thereof deteriorates.

The content of the polyisocyanate (PIC) in the polyester prepolymer including an isocyanate group (A) is not particularly limited and can be selected in accordance with the purpose. However, the polyester prepolymer including an isocyanate group (A) preferably includes the polyisocyanate (PIC) in an amount of from 0.5 to 40% by weight, more preferably from 1 to 30% by weight, and furthermore preferably from 2 to 20% by weight.

When less than 0.5% by weight, the hot offset resistance of the resultant toner deteriorates, which is difficult to have both thermostable preservability and low-temperature fixability. When greater than 40% by weight, the low-temperature fixability thereof deteriorates.

An average number of the isocyanate group included in the polyester prepolymer including an isocyanate group (A) per molecule is preferably not less than 1, more preferably from 1.5 to 3, and furthermore preferably from 1.8 to 2.5.

When less than 1, the polyester resin including a group formed by urea bonding (RMPE) has a lower molecular weight, and the hot offset resistance of the resultant toner deteriorates.

Tetrahydrofuran (THF) soluble components of the polymer reactable with the active-hydrogen-group-containing compound preferably have a weight-average molecular weight (Mw) of from 3,000 to 40,000, and more preferably from 4,000 to 30,000 in a gel permeation chromatography. When less than 3,000, the thermostable preservability of the resultant toner deteriorates. When greater than40,000, the low-temperature fixability thereof deteriorates.

The molecular weight is measured by GPC (gel permeation chromatography) as follows. A column is stabilized in a heat chamber having a temperature of 40° C.; THF is put into the column at a speed of 1 ml/min as a solvent; 50 to 200 μl of a THF liquid-solution of a resin, having a sample concentration of from 0.05 to 0.6% by weight, is put into the column; and amolecular weight distribution of the sample is determined by using a calibration curve which is previously prepared using several polystyrene standard samples having a single distribution peak, and which shows the relationship between a count number and the molecular weight. As the standard polystyrene samples for making the calibration curve, for example, the samples having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $48\times10^6$ from Pressure Chemical Co. or Tosoh Corporation are used. It is preferable to use at least 10 standard polystyrene samples. In addition, an RI (refraction index) detector is used as the detector.

The aqueous medium is not particularly limited and can be selected from known aqueous media.

Specific examples of the aqueous medium include water, a solvent compatible with water, a mixture thereof, etc. Particularly, water us preferably used.

The solvent compatible with water is not particularly limited as long as it is compatible with water. Specific examples thereof include alcohols such as methanol, isopropanol and ethylene glycol; dimethylformamide; tetrahydrofuran; cellosolves; lower ketones such as acetone and methyl ethyl ketone; etc. These can be used alone or in combination.

The aqueous medium preferably includes a dispersed particulate resin in an in an amount of from 0.5 to 10% by weight .

The particulate resin is not particularly limited so long as it is capable of forming an aqueous dispersion and can be selected from known resins. Specific examples thereof include any thermoplastic and thermosetting resins capable of forming a dispersion element such as vinyl resins, a polyurethane resin, an epoxy resin, a polyester resin, a polyamide resin, a polyimide resin, silicon resins, a phenol resin, a melamine resin, a urea resin, an aniline resin, an ionomer resin, a polycarbonate resin, etc.

These resins can be used alone or in combination. Among these resins, the vinyl resins, the polyurethane resin, the epoxy resin, the polyester resin and their combinations are preferably used in terms of forming an aqueous dispersion of microscopic spherical particulate resins.

Specific examples of the vinyl resins include homopolymerized or copolymerized polymers such as styrene-(metha) esteracrylate resins, styrene-butadiene copolymers, (metha) acrylic acid-esteracrylate polymers, styrene-acrylonitrile copolymers, styrene-maleic acid anhydride copolymers and styrene-(metha)acrylic acid copolymers.

As the particulate resin, a copolymer including a monomer having at least two unsaturated groups can also be used. The monomer having at least two unsaturated groups is not particularly limited, and can be selected in accordance with the purpose. Specific examples thereof include a sodium salt of a sulfate ester with an additive of ethylene oxide methacrylate (ELEMINOL RS-30 from Sanyo Chemical Industries, Ltd.), divinylbenzene, 1,6-hexanediolacrylate, etc.

The particulate resin can be prepared by any known polymerization methods, however, preferably prepared in the form of an aqueous dispersion thereof. The aqueous dispersion thereof can be prepared by the following methods:

(1) a method of directly preparing an aqueous dispersion of a vinyl resin from a vinyl monomer by a suspension polymerization method, an emulsification polymerization method, a seed polymerization method or a dispersion polymerization method;

(2) a method of preparing an aqueous dispersion of polyaddition or polycondensation resins such as a polyester resin, a polyurethane resin and an epoxy resin by dispersing a precursor (such as a monomer and an oligomer) or a solution thereof in an aqueous medium under the presence of a dispersant to prepare a dispersion, and heating the dispersion or adding a hardener thereto to harden the dispersion;

(3) a method of preparing an aqueous dispersion of polyaddition or polycondensation resins such as a polyester resin, a polyurethane resin and an epoxy resin by dissolving an emulsifier in a precursor (such as a monomer and an oligomer) or a solution (preferably a liquid or may be liquefied by heat) thereof to prepare a solution, and adding water thereto to subject the solution to a phase-inversion emulsification;

(4) a method of pulverizing a resin prepared by any polymerization methods such as addition condensation, ring scission polymerization, polyaddition and condensation polymerization with a mechanical or a jet pulverizer to prepare a pulverized resin and classifying the pulverized resin to prepare a particulate resin, and dispersing the particulate resin in an aqueous medium under the presence of a dispersant;

(5) a method of spraying a resin solution wherein a resin prepared by any polymerization methods such as addition condensation, ring scission polymerization, polyaddition and condensation polymerization is dissolved in a solvent to prepare a particulate resin, and dispersing the particulate resin in an aqueous medium under the presence of a dispersant;

(6) a method of adding a lean solvent in a resin solution wherein a resin prepared by any polymerization methods such as addition condensation, ring scission polymerization, polyaddition and condensation polymerization is dissolved in a solvent, or cooling a resin solution wherein the resin is dissolved upon application of heat in a solvent to separate out a particulate resin and removing the solvent therefrom, and dispersing the particulate resin in an aqueous medium under the presence of a dispersant;

(7) a method of dispersing a resin solution, wherein a resin prepared by any polymerization methods such as addition condensation, ring scission polymerization, polyaddition and condensation polymerization is dissolved in a solvent, in an aqueous medium under the presence of a dispersant, and removing the solvent upon application of heat or depressure; and (8) a method of dissolving an emulsifier in a resin solution wherein a resin prepared by any polymerization methods such as addition condensation, ring scission polymerization, polyaddition and condensation polymerization is dissolved in a solvent, and adding water thereto to subject the solution to a phase-inversion emulsification.

The solution or the dispersion of the toner constituents are preferably dispersed in the aqueous medium while stirred to emulsify or disperse the solution or the dispersion of the toner constituents therein. The dispersion methods are not particularly limited and can be selected in accordance with the purpose. Known dispersers such as low-speed shearing dispersers and high-speed shearing dispersers can be used.

The active-hydrogen-group-containing compound and the polymer reactable therewith are subjected to an elongation or a cross-linking reaction in the emulsification or the dispersion to produce the adhesive base material.

The adhesive base material has adhesiveness to a recording medium such as a paper, and includes at least an adhesive polymer formed from a reaction between the active-hydrogen-group-containing compound and the polymer reactable therewith in an aqueous medium, and may further include a binder resin selected from known binder resins.

The adhesive base material preferably has a weight-average molecular weight not less than 3,000, more preferably from 5,000 to 1,000,000, and much more preferably from 7,000 to 500,000.

When less than 3,000, the hot offset resistance of the resultant toner occasionally deteriorates.

The polymerization methods can prepare a small-size and spherical toner at low cost with less environmental load.

The developer of the present invention includes the toner of the present invention and may further includes components such as a carrier, and can be used as a one-component developer formed of a toner and a two-component developer formed of a toner and a carrier. The two-component developer is preferably used for high-speed printers in compliance with improvement of information process speed in terms of life improvement. The developers can be used for known electrophotographic methods such as magnetic one-component developing methods, non-magnetic one-component developing methods and two-component developing methods.

When the developer of the present invention is used as a one-component developer, the toner less varies in particle size and filming over a developing roller and fusion-bonding to a member such as a thin-layer forming blade of the toner can be prevented even after the toner is supplied and consumed for long periods. Therefore, the toner has stably good developability even after used (stirred) in the image developer for long periods.

When the developer of the present invention is used as a two-component developer, the toner less varies in particle size even after the toner is supplied and consumed for long periods and has stably good developability even after stirred in the image developer for long periods.

The two-component developer preferably includes the carrier in an amount of from 90 to 98% by weight, and more preferably from 90 to 97% by weight.

The carrier is not particularly limited, and can be selected in accordance with the purpose, however, preferably includes a core material and a resin layer coating the core material.

The core material is not particularly limited, and can be selected from known materials such as Mn—Sr materials and Mn-Mg materials having 50 to 90 emu/g; and highly magnetized materials such as iron powders having not less than 100 emu/g and magnetite having 75 to 120 emu/g for image density. In addition, light magnetized materials such as Cu—Zn materials having 30 to 80 emu/g are preferably used to decrease a stress to a photoreceptor having toner ears for high-quality images.

The core material preferably has a volume-average particle diameter (D50) of from 10 to 150 μm, and more preferably from 20 to 80 μm. When less than 10 μm, a magnetization per particle is so low that the carrier scatters. When larger than 150 μm, a specific surface area lowers and the toner occasionally scatters, and a solid image of a full-color image occasionally has poor reproducibility.

Specific examples of the resin coating the core material include amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, and silicone resins. These can be used alone or in combination.

An electroconductive powder may optionally be included in the resin layer. Specific examples of such electroconductive powders include, but are not limited to, metal powders, carbon blacks, titanium oxide, tin oxide, and zinc oxide. The average particle diameter of such electroconductive powders is preferably not greater than 1 μm. When the particle diameter is too large, it is hard to control the resistance of the resultant carrier.

The resin layer can be formed by preparing a coating liquid including a solvent and, e.g., the silicone resin; uniformly coating the liquid on the surface of the core material by a known coating method; and drying the liquid and burning the surface thereof. The coating method includes dip coating methods, spray coating methods, brush coating method, etc.

Specific examples of the solvent include, but are not limited to, toluene, xylene, methyl ethyl ketone, methyl isobutyl ketone, cellosolve butyl acetate, etc. Specific examples of the burning methods include, but are not limited to, externally heating methods or internally heating methods using fixed electric ovens, fluidized electric ovens, rotary electric ovens, burner ovens, microwaves, etc.

The carrier preferably includes the resin layer in an amount of from 0.01 to 5.0% by weight. When less than 0.010 by weight, a uniform resin layer cannot be formed on the core material. When greater than 5.0% by weight, the resin layer becomes so thick that carrier particles granulate one another and uniform carrier particles cannot be formed.

The developer container of the present invention contains the toner or the developer of the present invention. The container is not particularly limited, and can be selected from known containers such as a container having a cap.

The size, shape, structure, material, etc. thereof are not particularly limited, and can be selected in accordance with the purpose. The container preferably has the shape of a cylinder, and particularly, the cylinder preferably has a spiral concavity and convexity on the inside surface thereof such that a toner can transfer to an exit thereof when the cylinder rotates. In addition, a part or the all of the spiral is preferably a cornice. The materials for the container are not particularly limited, and resins having good size precision are preferably used, such as polyester resins, polyethylene resins, polypropylene resins, polystyrene resins, polyvinylchloride resins, polyacrylate resins, polycarbonate resins, ABS resins and polyacetal resins.

The developer container of the present invention is easy to store, transport and handle, and is detachable from a process cartridge and an image forming apparatus to feed the developer thereto.

The image forming method of the present invention preferably includes at least an electrostatic latent image forming process, a development process, a transfer process and a fixing process; more preferably a cleaning process; and optionally includes other processes such as a discharge process, a recycle process and a control process.

The image forming apparatus of the present invention preferably includes at least an electrostatic latent image bearer, an electrostatic latent image former, an image developer, a transferer and a fixer; more preferably a cleaner; and optionally includes other means such as a discharger, a recycler and a controller.

The image forming method of the present invention can be performed by the image forming apparatus of the present invention, the electrostatic latent image forming process, the developing process, the transferring process, the protection layer forming process, the fixing process are performed with the electrostatic latent image former, the image developer, the transferer, the protectant applicator and the fixer, respectively. The other optional processes can be performed with the optional means mentioned above.

The electrostatic latent image forming process is a process of forming an electrostatic latent image on a photoreceptor. The material, shape, structure, size, etc. of the photoreceptor are not particularly limited, and can be selected from known electrostatic latent image bearers. However, the electrostatic latent image bearer preferably has the shape of a drum, and the material is preferably an inorganic material such as amorphous silicon and serene, and an organic material such as polysilane and phthalopolymethine. Particularly, the amorphous silicon photoreceptors are preferably used in terms of long lives.

The electrostatic latent image is formed by uniformly charging the surface of the electrostatic latent image bearer and irradiating imagewise light onto the surface thereof with the electrostatic latent image former. The electrostatic latent image former includes at least a charger uniformly charging the surface of the electrostatic latent image bearer and an irradiator irradiating imagewise light onto the surface thereof.

The charger is not particularly limited, and specific examples thereof include electroconductive or semiconductive rollers, bushes, films, known contact chargers with a rubber blade, and non-contact chargers using a corona discharge such as corotron and scorotron.

The irradiator is not particularly limited, provided that the irradiator can irradiate the surface of the electrostatic latent image bearer with the imagewise light, and specific examples thereof include reprographic optical irradiators, rod lens array irradiators, laser optical irradiators and a liquid crystal shutter optical irradiators. In the present invention, a backside irradiation method irradiating the surface of the electrostatic latent image bearer through the backside thereof may be used.

The development process is a process of forming a visual image by developing the electrostatic latent image with the toner of the present invention. The image developer is not particularly limited, and can be selected from known image developers, provided that the image developer can develop with the toner of the present invention. For example, an image developer containing the developer of the present invention and being capable of feeding the toner to the electrostatic latent image in contact or not in contact therewith is preferably used, and an image developer including the toner container of the present invention is more preferably used.

The image developer may use dry or wet developing method, and may be single-color image developer or multicolor image developer. The image developer preferably has a stirrer stirring the developer of the present invention to be frictionally charged and a rotatable magnet roller. In the image developer, the toner and the carrier are mixed and stirred, and the toner is charged and held on the surface of the rotatable magnet roller in the shape of an ear to form a magnetic brush. Since the magnet roller is located close to the electrostatic latent image bearer, apart of the toner is electrically attracted to the surface thereof. Consequently, the electrostatic latent image is developed with the toner to form a toner image thereon. A developer contained in the image developer is the developer of the present invention, and may be a one-component or a two-component developer.

The transfer process is a process of transferring the toner image onto a recording medium, and it is preferable that the toner image is firstly transferred onto an intermediate transferer and secondly transferred onto a recording medium thereby. It is more preferable that two or more color toner images are firstly and sequentially transferred onto the intermediate transferer and the resultant complex full-color image is transferred onto the recording medium thereby.

The transferer preferably includes a first transferer transferring two or more visual color images onto an intermediate transferer and a second transferer transferring the resultant complex full-color image onto the recording medium. The intermediate transferer is not particularly limited, and can be selected from known transferers in accordance with the purpose, such as a transfer belt. Each of the first and second transferers preferably includes at least a transfer device chargeable to separate the visual image from the electrostatic latent image bearer toward the recoding medium. The transferer may include one, or two or more transfer devices.

The transferer device includes a corona transferer using a corona discharge, a transfer belt, a transfer roller, a pressure transfer roller, an adhesive roller, etc.

The recording medium is not particularly limited, and can be selected from known recording media (paper).

The fixing process is a process of fixing the toner image transferred onto the recording medium with a transferer, and each color toner may be fixed one by one or layered color toners may be fixed at the same time. The fixer is not particularly limited, can be selected in accordance with the purpose, and known heating and pressurizing means are preferably used. The heating and pressurizing means include a combination of a heating roller and a pressure roller, and a combination of a heating roller, a pressure roller and an endless belt, etc. The fixer of the present invention preferably includes a heater equipped with a heating element, a film contacting the heater and pressurizer contacting the heater through the film, wherein a recording material an unfixed image is formed on passes through between the film and pressurizer to fix the unfixed image upon application of heat. The heating temperature is preferably from 80 to 200° C. A known optical fixer may be used with or instead of the fixer in accordance with the purpose.

The fixing process is a process of fixing the toner image transferred onto the recording medium with a transferer, and each color toner may be fixed one by one or layered color toners may be fixed at the same time. The fixer is not particularly limited, can be selected in accordance with the purpose, and known heating and pressurizing means are preferably used. The heating and pressurizing means include a combination of a heating roller and a pressure roller, and a combination of a heating roller, a pressure roller and an endless belt, etc. The fixer of the present invention preferably includes a heater equipped with a heating element, a film contacting the heater and pressurizer contacting the heater through the film, wherein a recording material an unfixed image is formed on passes through between the film and pressurizer to fix the unfixed image upon application of heat. The heating temperature is preferably from 80 to 200° C. A known optical fixer may be used with or instead of the fixer in accordance with the purpose.

The discharge process is a process of preferably discharging the electrostatic latent image bearer with a discharger upon application of discharge bias. The discharger is not particularly limited, and can be selected from known dischargers, provided that the discharger can apply the discharge bias to the electrostatic latent image bearer, such as a discharge lamp.

The cleaning process is a process of preferably removing a toner remaining on the electrostatic latent image bearer with a cleaner. The cleaner is not particularly limited, and can be selected from known cleaners, provided that the cleaner can remove the toner remaining thereon, such as a magnetic brush cleaner, an electrostatic brush cleaner, a magnetic roller cleaner, a blade cleaner, a brush cleaner and web cleaner.

The toner recycle process is a process of preferably recycling a toner removed by the cleaner with a recycler. The recycler is not particularly limited, and known transporters can be used.

The control process is a process of preferably controlling the above-mentioned processes with a controller. The controller is not particularly limited, and can be selected in accordance with the purposes, provided the controller can control the above-mentioned means, such as a sequencer and a computer.

FIG. 1 is a schematic view illustrating an embodiment of the image forming apparatus of the present invention. An image forming apparatus 100A therein includes a photoreceptor drum 10 as an electrostatic latent image bearer, a charging roller as a charger 20, an irradiator (not shown), an image developer, an intermediate transferer 50, a cleaner 60 having a cleaning blade and a discharge lamp 70 as a discharger.

The intermediate transferer 50 is an endless belt suspended and extended by three rollers 51, and is transportable in the direction indicated by an arrow. The three rollers 51 partly work as a transfer bias roller capable of applying a predetermined first transfer bias to the intermediate transferer 50.

A cleaner 90 having a cleaning blade is located close thereto. Further, a transfer roller 80 capable of applying a transfer bias to a transfer paper 95 is located facing the intermediate transferer 50.

Around the intermediate transferer 50, corona chargers 52 charging the toner image thereon is located between a contact point of the photoreceptor 10 and the intermediate transferer 50 and a contact point of the intermediate transferer 50 and a transfer paper 95.

The image developer developing each color black (K), yellow (Y), magenta (M) and cyan (C) includes a developer feed roller 42 and a developing roller 43.

The charging roller 20 uniformly charges the photoreceptor 10. The irradiator (not shown) irradiates imagewise light (L) to the photoreceptor 10 to form an electrostatic latent image thereon. The electrostatic latent image formed thereon is developed with a toner fed from the image developer 40 to form a toner image thereon. The toner image is transferred (first transfer) onto the intermediate transferer 50 with a voltage applied from the corona charger 52, and is further transferred (second transfer) onto a transfer paper 95. The toner remaining on the photoreceptor 10 is removed by a cleaner 60, and the photoreceptor 10 is discharged by the discharge lamp 70.

Figure 2:
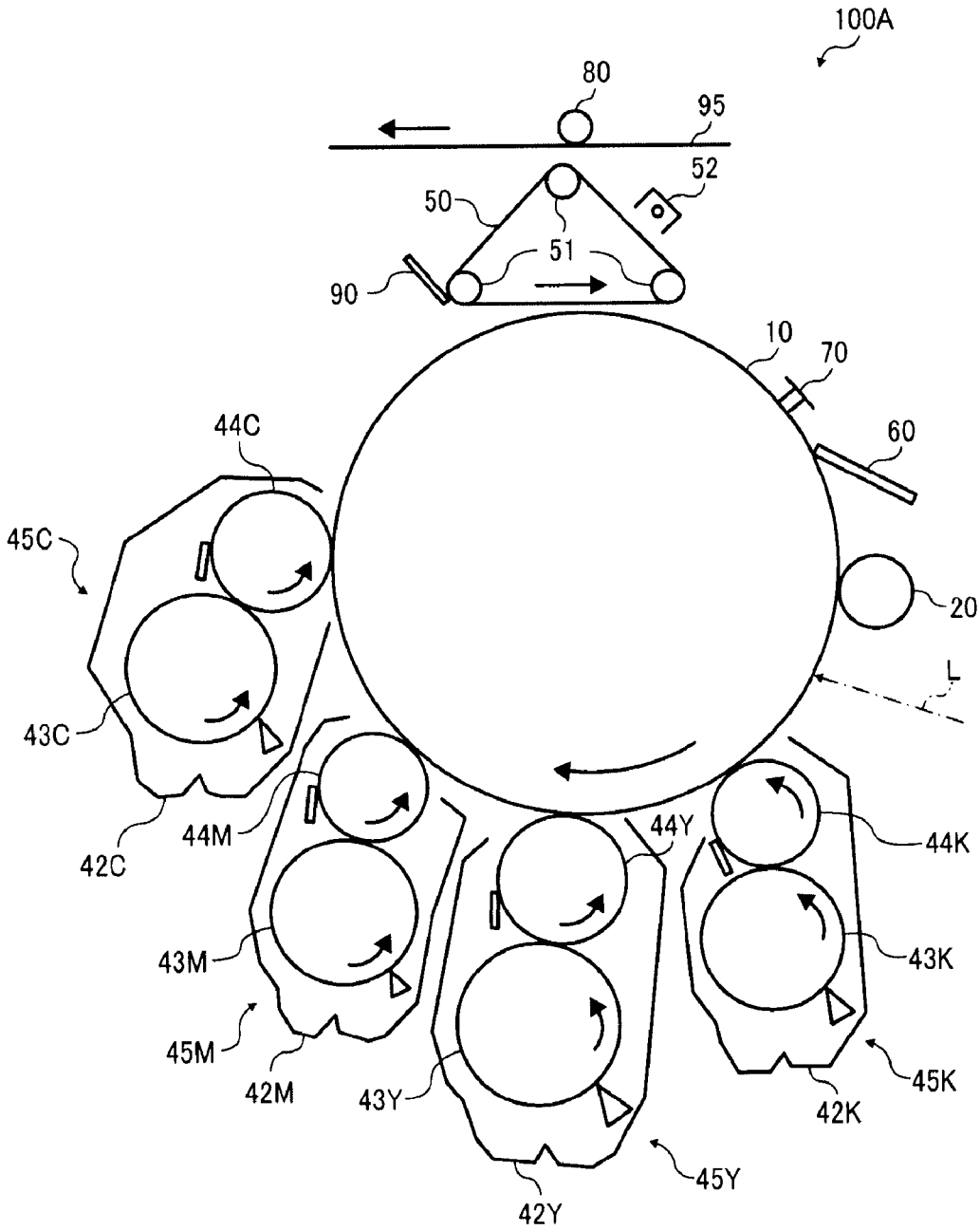
FIG. 2 is a schematic view illustrating an embodiment of the image forming apparatus of the present invention.

FIG. 2 is a schematic view illustrating another embodiment of the image forming apparatus for use in the present invention. An image forming apparatus (100B) therein is a tandem full-color image forming apparatus, including a duplicator 150, a paper feeding table 200, a scanner 300 and an automatic document feeder (ADF) 400.

The duplicator 150 includes an intermediate transferer 50 having the shape of an endless belt. An intermediate transferer 50 is suspended by three suspension rollers 14, 15 and 16 and rotatable in a direction indicated by an arrow.

A cleaner 17 is located close to the suspension roller 15 to remove a residual toner on the intermediate transferer 50. Above the intermediate transferer 50, four image forming units 18 for yellow, cyan, magenta and black colors are located in line from left to right along a transport direction of the intermediate transferer 50 to form a tandem image forming developer 120.

Figure 3:
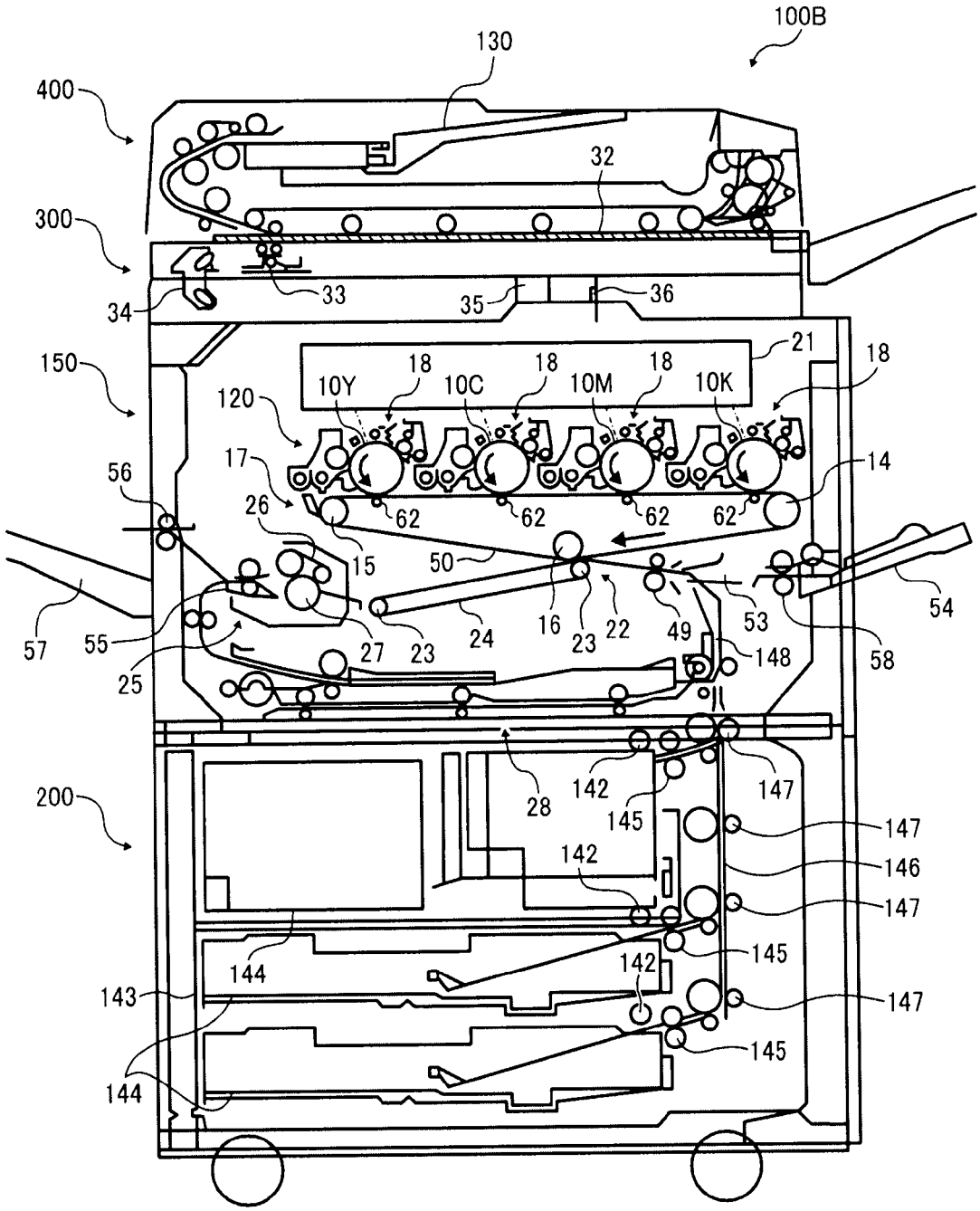
FIG. 3 is a schematic view illustrating another embodiment of the image forming apparatus of the present invention.

Each of the image forming units 18, as shown in FIG. 3, includes a photoreceptor drum 10; a charging roller 60 uniformly charging the photoreceptor drum 10; an image developer 70 developing an electrostatic latent image formed on the photoreceptor drum 10 with each color developer black (K), yellow (Y), magenta (M) and cyan (C) to form a toner image; a transfer roller 62 transferring each color toner image onto the intermediate transferer 50; a cleaner 63 and a discharge lamp 64.

An irradiator (not shown) is located close to the tandem image forming developer 120. The irradiator irradiates the photoreceptor drum 10 with imagewise light to form an electrostatic latent image.

On the opposite side of the tandem color image developer 120 across the intermediate transferer 50, a second transferer 22 is located. The second transferer 22 includes a an endless second transfer belt 24 suspended by a pair of rollers 23, and a recording paper fed on the second transfer belt 24 and the intermediate transferer 50 can contact each other.

A fixer 25 fixing a transferred image on the sheet is located close to the second transferer 22. The fixer 25 includes an endless fixing belt 26 and a pressure roller 27 pressing the fixing belt 26.

In addition, a sheet reverser 28 reversing the sheet to form an image on both sides thereof is located close to the second transferer 22 and the fixer 25.

Full-color image formation using in the image forming apparatus 100B will be explained. An original is set on a table 130 of the ADF 400 to make a copy, or on a contact glass 32 of the scanner 300 and pressed with the ADF 400. When a start switch (not shown) is put on, a first scanner 33 and a second scanner 34 scans the original after the original set on the table 130 of the ADF 400 is fed onto the contact glass 32 of the scanner 300, or immediately when the original set thereon. The first scanner 33 emits light to the original and reflects reflected light therefrom to the second scanner 34. The second scanner further reflects the reflected light to a reading sensor 36 through an imaging lens 35 to read the color original (color image) as image information of black, yellow, magenta and cyan.

Further, after each color electrostatic latent image is formed on the photoreceptor drum 10 by the irradiator 30 based on image information of the each color, the each color electrostatic latent image is developed with a developer fed from each color image developer to form each color toner images. The each color toner image is sequentially transferred (first transfer) onto the intermediate transferer 50 being rotated by the suspension rollers 14, 15 and 16 to form a multiple toner image thereon.

On the other hand, one of paper feeding rollers 142 of paper feeding table 200 is selectively rotated to take a sheet out of one of multiple-stage paper cassettes 144 in a paper bank 143. A separation roller 145 separates sheets one by one and feed the sheet into a paper feeding route 146, and a feeding roller 147 feeds the sheet into a paper feeding route 148 to be stopped against a registration roller 49. Alternatively, a paper feeding roller 150 is rotated to take a sheet out of a manual feeding tray 51, and a separation roller 52 separates sheets one by one and feed the sheet into a paper feeding route 53 to be stopped against the registration roller 49. The registration roller 49 is typically earthed, and may be biased to remove a paper dust from the sheet.

Then, in timing with the multiple toner image on the intermediate transferer 50, the registration roller 49 is rotated to feed the sheet between the intermediate transferer 50 and the second transferer 22, and the second transferer transfers (second transfer) the multiple toner image onto the recording paper.

The recording paper the multiple toner image is transferred on is fed by the second transferer 22 to the fixer 25. The fixer 25 fixes the image thereon upon application of heat and pressure, and the sheet is discharged by a discharge roller 56 onto a catch tray 57 through a switch-over click 55. Alternatively, the switch-over click 55 feeds the sheet into the sheet reverser 28 reversing the sheet to a transfer position again to form an image on the backside of the sheet, and then the sheet is discharged by the discharge roller 56 onto the catch tray 57.

The intermediate transferer 50 after transferring an image is cleaned by the cleaner 17 to remove a residual toner thereon after the image is transferred.

Figure 4:
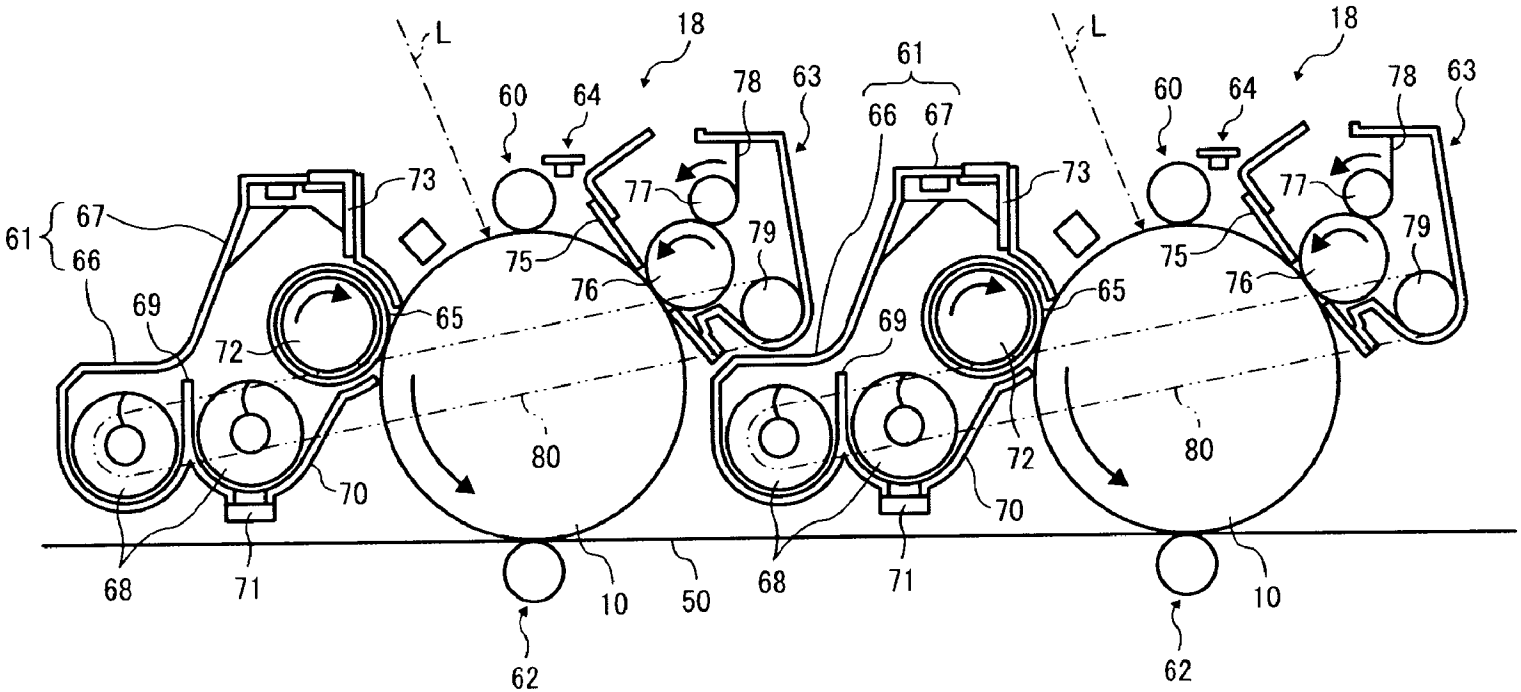
FIG. 4 is a schematic view illustrating a tandem image developer in the image forming apparatus in FIG. 3.
Figure 5:
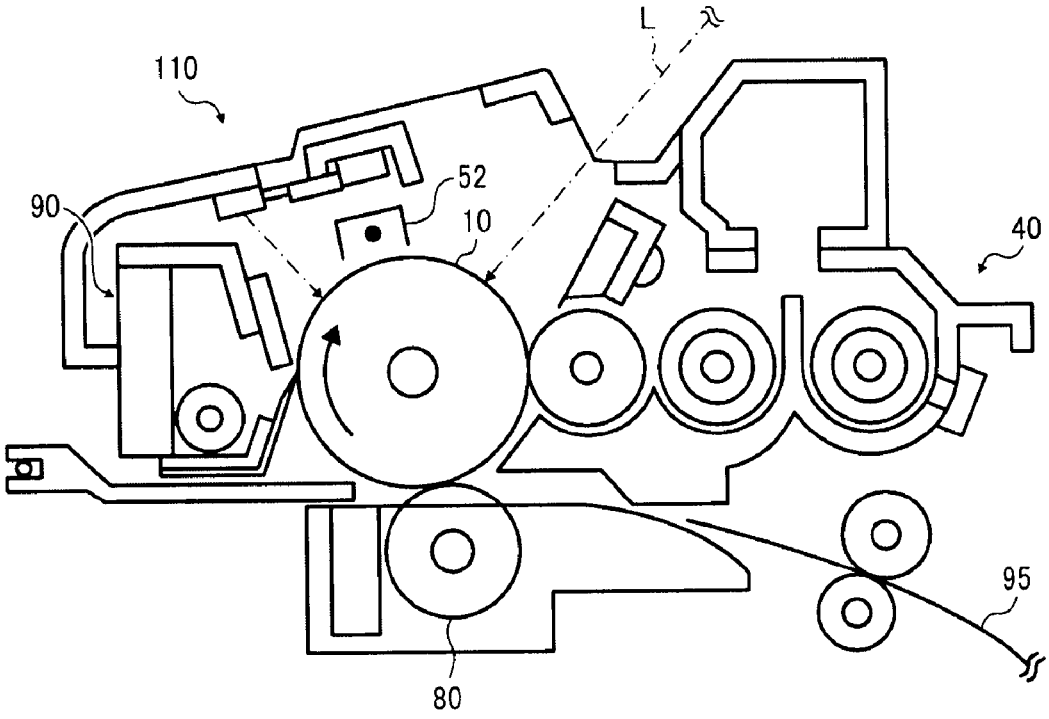
FIG. 5 is a schematic view illustrating an embodiment of the process cartridge of the present invention.

FIG. 4 is a schematic view illustrating an embodiment of the process cartridge of the present invention. A process cartridge 110 includes a photoreceptor drum 10, a corona charger 52, an image developer 40, a transfer roller 80 and a cleaner 90.

The process cartridge of the present invention is formed detachable from various image forming apparatuses includes at least an electrostatic latent image bearer bearing an electrostatic latent image and an image developer developing the electrostatic latent image borne by the electrostatic latent image bearer. The process cartridge of the present invention may further include other means.

The image developer includes at least a developer container containing the developer of the present invention and a developer bearer bearing and feeding the developer contained in the developer container. The mage developer may further include a regulation member regulating a thickness of the developer borne by the developer bearer.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis of Polyester Resin A 65 parts of an adduct of bisphenol A with 2 moles of ethyleneoxide, 86 parts of an adduct of bisphenol A with 3 moles of propyleneoxide, 274 parts terephthalic acid and 2 parts of dibutyltinoxide were reacted in a reactor vessel including a cooling pipe, a stirrer and a nitrogen inlet pipe for 15 hrs at a normal pressure and 230° C. Next, the mixture was depressurized by 10 to 15 mm Hg and reacted for 6 hrs to prepare a polyester resin A.

The polyester A had a number-average molecular weight (Mn) of 2,300, a weight-average molecular weight (Mw) of 6,000, a Tg of 58° C., an acid value of 25 mg KOH/g and a hydroxyl value of 35 mg KOH/g.

Synthesis of Polyester Resin B 102 parts of an adduct of bisphenol A with 2 moles of ethyleneoxide, 49 parts of an adduct of bisphenol A with 3 moles of propyleneoxide, 280 parts terephthalic acid and 2 parts of dibutyltinoxide were reacted in a reactor vessel including a cooling pipe, a stirrer and a nitrogen inlet pipe for 8 hrs at a normal pressure and 230° C. Next, the mixture was depressurized by 10 to 15 mm Hg and reacted for 5 hrs to prepare a polyester resin B.

The polyester B had a number-average molecular weight of 2,100, a weight-average molecular weight of 6,200, a Tg of 70° C., an acid value of 25 mg KOH/g and a hydroxyl value of 40 mg KOH/g.

Synthesis of Polyester Resin C 62 parts of an adduct of bisphenol A with 2 moles of ethyleneoxide, 89 parts of an adduct of bisphenol A with 3 moles of propyleneoxide, 290 parts terephthalic acid and 2 parts of dibutyltinoxide were reacted in a reactor vessel including a cooling pipe, a stirrer and a nitrogen inlet pipe for 8 hrs at a normal pressure and 230° C. Next, the mixture was depressurized by 10 to 15 mm Hg and reacted for 5 hrs to prepare a polyester resin B.

The polyester B had a number-average molecular weight of 2,100, a weight-average molecular weight of 5,600, a Tg of 48° C., an acid value of 35 mg KOH/g and a hydroxyl value of 45 mg KOH/g.

Synthesis of Polyester Resin D 70 parts of an adduct of bisphenol A with 2 moles of ethyleneoxide, 80 parts of an adduct of bisphenol A with 3 moles of propyleneoxide, 250 parts terephthalic acid, 30 parts of trimellitic acid and 3 parts of dibutyltinoxide were reacted in a reactor vessel including a cooling pipe, a stirrer and a nitrogen inlet pipe for 8 hrs at a normal pressure and 230° C. Next, the mixture was depressurized by 10 to 15 mm Hg and reacted for 10 hrs to prepare a polyester resin D.

The polyester D had a number-average molecular weight of 6,100, a weight-average molecular weight of 25,600, a Tg of 68° C., an acid value of 35 mg KOH/g and a hydroxyl value of 25 mg KOH/g.

Synthesis of Crystalline Polyester Resin 1

2,300 g of 1,10-decanediol, 2,530 g of 1,8-octanediol and 4.9 g of hydroquinone were placed in a 5 litter four-necked flask having a nitrogen inlet tube, a dehydration tube, a stirrer and a thermo couple and reacted with each other at 180° C. for 10 hrs, further reacted for 3 hrs at 200° C., and further reacted for 2 hrs at 8.3 kPa to prepare a crystalline polyester 1. DSC thermal properties and GPC molecular weight thereof are shown in Table 1.

Synthesis of Crystalline Polyester Resin 2

2,160 g of fumaric acid, 2,320 g of 1,6-hexanediol and 4.9 g of hydroquinone were placed in a 5 litter four-necked flask having a nitrogen inlet tube, a dehydration tube, a stirrer and a thermo couple and reacted with each other at 180° C. for 10 hrs, further reacted for 3 hrs at 200° C., and further reacted for 2 hrs at 8.3 kPa to prepare a crystalline polyester 1. DSC thermal properties and GPC molecular weight thereof are shown in Table 1.

Synthesis of Crystalline Polyester Resin 3

2,320 g of adipic acid, 2,880 g of 1,8-pentadiol and 4.9 g of hydroquinone were placed in a 5 litter four-necked flask having a nitrogen inlet tube, a dehydration tube, a stirrer and a thermo couple and reacted with each other at 180° C. for 10 hrs, further reacted for 3 hrs at 200° C., and further reacted for 2 hrs at 8.3 kPa to prepare a crystalline polyester 1. DSC thermal properties and GPC molecular weight thereof are shown in Table 1.

TABLE 1

| | T2-cp (° C.) | T2-cs1 (° C.) | T2-Cp (° C.) | Mw | Mn | Mw/Mn |
|---|---|---|---|---|---|---|
| Crystalline Polyester Resin 1 | 70 | 65 | 73 | 10,000 | 3,000 | 3.3 |
| Crystalline Polyester Resin 2 | 86 | 65 | 98 | 13,000 | 2,500 | 5.2 |
| Crystalline Polyester Resin 3 | 58 | 40 | 63 | 12,000 | 2,300 | 5.2 |

Synthesis of Styrene-Acrylic Resin A 300 parts of ethylacetate, 185 parts of styrene, 115 parts of acrylic monomer and 5 parts of azobisisobutylnitrile were reacted in a reactor vessel including a cooling pipe, a stirrer and a nitrogen inlet pipe under a nitrogen atmosphere for 8 hrs at a normal pressure and 65° C. to prepare a mixture. Next, 200 parts of methanol were added thereto, the mixture was stirred for 1 hr and dried under educed pressure to prepare a styrene-acrylic resin A.

The styrene-acrylic resin A had a Mw of 20,000 and a Tg of 58° C.

Synthesis of Prepolymer 682 parts of an adduct of bisphenol A with 2 moles of ethyleneoxide, 81 parts of an adduct of bisphenol A with 2 moles of propyleneoxide, 283 parts terephthalic acid, 22 parts of trimellitic acid anhydride and 2 parts of dibutyltinoxide were mixed and reacted in a reactor vessel including a cooling pipe, a stirrer and a nitrogen inlet pipe for 8 hrs at a normal pressure and 230° C. Further, after the mixture was depressurized by 10 to 15 mm Hg and reacted for 5 hrs to prepare an intermediate polyester resin. The intermediate polyester resin had a number-average molecular weight of 2,100, a weight-average molecular weight of 9,600, a Tg of 55° C. and an acid value of 0.5 mg KOH/g and a hydroxyl value of 49 mg KOH/g.

Next, 411 parts of the intermediate polyester resin, 89 parts of isophoronediisocyanate and 500 parts of ethyl acetate were reacted in a reactor vessel including a cooling pipe, a stirrer and a nitrogen inlet pipe for 5 hrs at 100° C. to prepare a prepolymer (The polymer reactable with the compound including an active hydrogen group).

The prepolymer included a free isocyanate in an amount of 1.60% by weight and had a solid content concentration of 50% by weight after left for 45 min at 150° C.

Synthesis of Ketimine (Active-Hydrogen-Group-Containing Compound)

30 parts of isophoronediamine and 70 parts of methyl ethyl ketone were reacted at 50° C. for 5 hrs in a reaction vessel including a stirrer and a thermometer to prepare a ketimine compound.

The ketimine compound had an amine value of 423 mg KOH/g.

Preparation of Masterbatch 1,000 parts of water, 540 parts of carbon black Printex 35 from Degussa A.G. having a DBP oil absorption of 42 ml/100 mg and a pH of 9.5, 1,200 parts of the polyester resin A were mixed by a Henschel mixer from Mitsui Mining Co., Ltd. After the mixture was kneaded by a two-roll mill having a surface temperature of 150° C. for 30 min, the mixture was extended by applying pressure, cooled and pulverized by a pulverizer from Hosokawa Micron Limited to prepare a masterbatch.

Example 1

Preparation of Aqueous Medium 306 parts of ion-exchanged water, 265 parts of a suspension liquid of tricalcium phosphate having a concentration of 10% by weight and 1.0 part of sodium dodecyldiphenyletherdisulfonate were mixed, stirred and uniformly dissolved to prepare an aqueous solution.

The sodium dodecyldiphenyletherdisulfonate had a critical micellar concentration of 0.05% by weight based on total weight of the aqueous medium when measured by a surface tensiometer Sigma.

Preparation of Toner Constituents Liquid 70 parts of the polyester resin A, 10 parts of the prepolymer and 100 parts of ethylacetate were stirred and dissolved in a beaker to prepare a solution. 5 parts of a paraffin wax HNP-9 (having a melting point of 75° C. from Nippon Seiro Co., Ltd.)

as a release agent, 10 parts of stearic acid amide (NEUTRON 2 having a melting point of 99° C. from Nippon Fine Chemical Co., Ltd.) as a fixing supplemental component and 10 parts of the masterbatch were added to the solution and the solution was dispersed by a beads mill (Ultra Visco Mill from IMECS CO., LTD.) for 3 passes under the following conditions:

liquid feeding speed of 1 kg/hr; peripheral disc speed of 6 m/sec; and filling zirconia beads having diameter of 0.5 mm for 80% by volume to prepare a dispersion.

Then, 2.7 parts by weight of the ketimine were added to the dispersion to prepare a toner constituents liquid.

Preparation of Emulsion or dispersion 150 parts of the aqueous medium were placed in a container and stirred by TK homomixer from Tokushu Kika Kogyo Co., Ltd. at 12,000 rpm, and 100 parts of the toner constituents liquid were added in the aqueous medium and mixed therein for 10 min thereby to prepare an emulsion or dispersion (an emulsified slurry).

Removal of Organic Solvent 100 parts of the emulsified slurry were placed in a flask with a stirrer and a thermometer and de-solvented at 30° C. for 12 hrs while stirred at a stirring peripheral speed of 20 m/min.

Washing

After 100 parts of the dispersion slurry was filtered under reduced pressure, 100 parts of ion-exchange water were added to the filtered cake and mixed by T. K. Homomixer at 12,000 rpm for 10 min, and the mixture was filtered. 20 parts of an aqueous solution of 10% sodium hydrate were added to the filtered cake and mixed by the TK-type homomixer at 12,000 rpm for 10 min, and the mixture was filtered under reduced pressure. Further, 20 parts of 10% hydrochloric acid were added to the filtered cake and mixed by the TK-type homomixer at 12,000 rpm for 10 min, and the mixture was filtered. 300 parts of ion-exchanged water were added to the filtered cake and mixed by the TK-type homomixer at 12,000 rpm for 10 min, and the mixture was filtered. This operation was repeated again.

Drying

The filtered cake was dried by an air drier at 45° C. for 48 hrs and sieved by a mesh having an opening of 75 μm to prepare a parent toner.

Adding External additive 100 parts of the parent toner, 0.6 parts of hydrophobic silica having an average particle diameter of 100 nm and 1.0 part of hydrophobized titanium oxide having an average particle diameter of 20 nm were mixed by a HENSCHEL MIXER to prepare a toner.

Example 2

Synthesis of Dibasic Ester Compound 100 parts of adipic acid and 100 parts of stearyl alcohol were placed in a reaction container with a catalyst, and esterified at 240° C. under a nitrogen stream to synthesize a dibasic ester compound (i) having a melting point of 80° C. and an acid value of 20 mg KOH/g.

The procedure for preparation of the toner in Example 1 was repeated except for replacing the stearic acid amide with the dibasic ester compound (i) in preparation of the toner constituents liquid.

Example 3

Synthesis of Ester Compound 100 parts of behenic acid, 100 parts of stearic acid and 50 parts of ethylene glycol were placed in a reaction container with a catalyst, and esterified at 240° C. under a nitrogen stream to synthesize an ester compound (ii) having a melting point of 77° C. and a hydroxyl value of 30 mg KOH/g.

The procedure for preparation of the toner in Example 1 was repeated except for replacing the stearic acid amide with the ester compound (ii) in preparation of the toner constituents liquid.

Example 4

The procedure for preparation of the toner in Example 1 was repeated except for replacing the prepolymer with the polyester resin D in preparation of the toner constituents liquid.

Example 5

The procedure for preparation of the toner in Example 1 was repeated except for replacing the polyester resin A with the polyester resin B in preparation of the toner constituents liquid.

Example 6

The procedure for preparation of the toner in Example 1 was repeated except for replacing the polyester resin A with the polyester resin C in preparation of the toner constituents liquid.

Example 7

The procedure for preparation of the toner in Example 1 was repeated except for replacing the stearic acid amide with a behenic acid (NAA 222 from NOF Corp.) in preparation of the toner constituents liquid.

Example 8

The procedure for preparation of the toner in Example 1 was repeated except for replacing the paraffin wax with a carnauba wax (WA-05 from TOAKASEI Co., Ltd., having a melting point of 86° C.) in preparation of the toner constituents liquid.

Example 9

The procedure for preparation of the toner in Example 1 was repeated except for replacing the stearic acid amide with the crystalline polyester resin 1.

Example 10

The procedure for preparation of the toner in Example 1 was repeated except for replacing the stearic acid amide with the crystalline polyester resin 2.

Example 11

The procedure for preparation of the toner in Example 1 was repeated except for replacing the stearic acid amide with the crystalline polyester resin 3.

Comparative Example 1

The procedure for preparation of the toner in Example 1 was repeated except for not adding stearic acid amide as a fixing supplemental component in preparation of the toner constituents liquid.

Comparative Example 2

The procedure for preparation of the toner in Example 1 was repeated except for replacing the polyester resin A with the styrene acrylic resin A in preparation of the toner constituents liquid.

Comparative Example 3

The procedure for preparation of the toner in Example 1 was repeated except for not adding the prepolymer in preparation of the toner constituents liquid.

Comparative Example 4

The procedure for preparation of the toner in Example 1 was repeated except for not adding the stearic acid amide and replacing the polyester resin A with the polyester resin C in preparation of the toner constituents liquid.

Comparative Example 5

The procedure for preparation of the toner in Example 1 was repeated except for changing the preparation of a toner constituents liquid as follows.

Preparation of Toner Constituents Liquid 60 parts of the polyester resin A, 15 parts of the prepolymer and 100 parts of ethylacetate were stirred and dissolved in a beaker to prepare a solution. 10 parts of a carnauba wax (WA-05 from TOAKASEI Co., Ltd., having a melting point of 86° C.) as a release agent, 10 parts of a behenic acid (NAA 222 from NOF Corp .) as a fixing supplemental component and 10 parts of the masterbatch were added to the solution and the solution was dispersed by a beads mill (Ultra Visco Mill from IMECS CO., LTD.) for 3 passes under the following conditions:

liquid feeding speed of 1 kg/hr; peripheral disc speed of 6 m/sec; and filling zirconia beads having diameter of 0.5 mm for 80% by volume to prepare a dispersion.

Then, 2.7 parts by weight of the ketimine were added to the dispersion to prepare a toner constituents liquid.

The toners prepared in Examples 1 to 11 and Comparative Examples 1 to 5 are shown in Table 2.

TABLE 2

| | Resin 1/ parts | Resin 2/ parts | Prepolymer/ parts | Fixing supplemental component | Release agent/parts |
|---|---|---|---|---|---|
| Example 1 | Polyester resin A/ 70 | — | 10 | Stearic acid amide/10 | Paraffin/5 |
| Example 2 | Polyester resin A/ 70 | — | 10 | Dibasic ester compound (i)/10 | Paraffin/5 |
| Example 3 | Polyester resin A/ 70 | — | 10 | Ester compound (ii)/10 | Paraffin/5 |
| Example 4 | Polyester resin A/ 70 | Polyester resin D/ 10 | 0 | Stearic acid amide/10 | Paraffin/5 |
| Example 5 | Polyester resin B/ 70 | — | 10 | Stearic acid amide/10 | Paraffin/5 |
| Example 6 | Polyester resin C/ 70 | — | 10 | Stearic acid amide/10 | Paraffin/5 |
| Example 7 | Polyester resin A/ 70 | — | 10 | Behenic acid/10 | Paraffin/5 |
| Example 8 | Polyester resin A/ 70 | — | 10 | Stearic acid amide/10 | Carnauba/5 |
| Example 9 | Polyester resin A/ 70 | — | 10 | Crystalline polyester 1 | Paraffin/5 |
| Example 10 | Polyester resin A/ 70 | — | 10 | Crystalline polyester 2 | Paraffin/5 |
| Example 11 | Polyester resin A/ 70 | — | 10 | Crystalline polyester 3 | Paraffin/5 |
| Comparative Example 1 | Polyester resin A/ 70 | — | 10 | Nil | Paraffin/5 |
| Comparative Example 2 | Styrene acrylic resin A | — | 10 | Stearic acid amide/10 | Paraffin/5 |
| Comparative Example 3 | Polyester resin A/ 70 | — | 0 | Stearic acid amide/10 | Paraffin/5 |
| Comparative Example 4 | Polyester resin A/ 70 | — | 10 | Nil | Paraffin/5 |
| Comparat ive Example 5 | Polyester resin A/ 60 | — | 15 | Behenic acid/10 | Carnauba/10 |

Preparation of Carrier

The following materials were mixed and dispersed by a homomixer for 20 min to prepare a coating liquid. The coating liquid was coated by a fluidized-bed coater on 1,000 parts of spherical magnetite having a particle diameter of 50 μm to prepare a carrier.

| | |
|---|---|
| Silicons resin (organo straight silicone) | 100 |
| Toluene | 100 |
| γ-(2-aminoethyl)aminopropyltrimethoxysilane | 5 |
| Carbon black | 10 |

Preparation of Developer 5 parts of each of the toners of Examples 1 to 8 and Comparative Examples 1 to 5 and 95 parts of the carrier were mixed by a ball mill to prepare developers.

The developers were evaluated as follows. The results are shown in Table 3.

Minimum Fixable Temperature

Ricoh Paper Type 6200 was set in a copier MF-200 from Ricoh Company. Ltd., which is equipped with a TEFLON (registered mark) roller for the fixing roller and having a modified fixer to perform a coping test. The fixing temperature was changed in increments of 5° C. A minimum temperature of the fixing roller at which a residual ratio of the image density of a fixed image after scraped with a pat is not less than 70% was the minimum fixable temperature. The minimum fixable temperature is preferably lower to reduce electric consumption, and 130° C. or less has practically no problem.

Hot Offset Occurrence Temperature

A silicone oil applicator was removed from a fixing unit of tandem type full-color image forming apparatus Imagio Neo C350 from Ricoh Company, Ltd. to modify the apparatus so as to use an oilless fixing method. In addition, the apparatus was tuned so that the temperature and the linear speed were adjustable. The apparatus was controlled to develop a toner image having a weight of 0.85±0.3 mg/cm$^2$. The toner image was fixed while the temperature of the fixing roller was changed in increments of 5° C. A fixing temperature (offset occurrence temperature) at which hot offset occurs was measured, a maximum temperature of the fixing roller capable of fixing a toner image without occurrence of hot offset was maximum fixable temperature. The maximum fixable temperature is preferably higher to increase a margin against offset, and 180° C. or more has practically no problem.

Thermostable Storage Stability

A glass container having a capacity of 50 ml is filled with a toner, and the glass container is left in a constant-temperature bath at 50° C. for 24 hrs. Then, the toner is cooled to have a temperature of 24° C. and a penetration is measured (JIS K2235-1991) to evaluate thermostable storage stability under the following standard:

25 mm or more; very good 15 mm or more and less than 25 mm; good 5 mm or more and less than 15 mm; poor Less than 5 mm; very poor.

The larger the penetration, the better the thermostable storage stability. When less than 5 mm, it is highly possible that the toner has problems in use.

TABLE 3

| | FX | | | Tg1st | Tg2nd | Q1 | Q2 | G' (pa) | | | | |
|---|---|---|---|---|---|---|---|---|---|---|---|---|
| | MF | HO | TSS | (° C.) | (° C.) | (° C.) | (° C.) | 80° C. | 90° C. | 100° C. | 120° C. | 150° C. |
| Ex. 1 | 115° C. | 200° C. | Good | 63 | 40 | 75 | 90 | $1.3 \times 10^5$ | $2.4 \times 10^4$ | $1.1 \times 10^4$ | $6.2 \times 10^3$ | $4.5 \times 10^3$ |
| Ex. 2 | 115° C. | 200° C. | Good | 65 | 42 | 75 | 80 | $1.8 \times 10^5$ | $2.7 \times 10^4$ | $1.3 \times 10^4$ | $6.5 \times 10^3$ | $4.8 \times 10^3$ |
| Ex. 3 | 115° C. | 195° C. | Good | 63 | 41 | 75 | 77 | $1.5 \times 10^5$ | $2.6 \times 10^4$ | $1.2 \times 10^4$ | $6.8 \times 10^3$ | $4.1 \times 10^3$ |
| Ex. 4 | 115° C. | 185° C. | Good | 58 | 40 | 75 | 90 | $1.1 \times 10^5$ | $2.1 \times 10^4$ | $8.9 \times 10^3$ | $3.2 \times 10^3$ | $2.1 \times 10^3$ |
| Ex. 5 | 125° C. | 205° C. | Very good | 71 | 48 | 75 | 90 | $2.5 \times 10^5$ | $3.5 \times 10^4$ | $2.1 \times 10^4$ | $7.8 \times 10^3$ | $5.6 \times 10^3$ |
| Ex. 6 | 115° C. | 190° C. | Poor | 49 | 39 | 75 | 90 | $9.2 \times 10^4$ | $1.5 \times 10^4$ | $7.8 \times 10^4$ | $5.4 \times 10^3$ | $3.4 \times 10^3$ |
| Ex. 7 | 125° C. | 200° C. | Good | 61 | 45 | 75 | 77 | $2.8 \times 10^5$ | $4.2 \times 10^4$ | $3.0 \times 10^4$ | $5.2 \times 10^3$ | $3.4 \times 10^3$ |
| Ex. 8 | 125° C. | 190° C. | Good | 63 | 41 | 75 | 85 | $1.7 \times 10^5$ | $2.7 \times 10^4$ | $1.5 \times 10^4$ | $6.1 \times 10^3$ | $4.2 \times 10^3$ |
| Ex. 9 | 110° C. | 190° C. | Good | 63 | 28 | 68 | 75 | $9.5 \times 10^4$ | $1.3 \times 10^4$ | $6.8 \times 10^3$ | $4.2 \times 10^3$ | $3.8 \times 10^3$ |
| Ex. 10 | 125° C. | 185° C. | Good | 63 | 35 | 75 | 82 | $2.2 \times 10^5$ | $2.5 \times 10^4$ | $1.8 \times 10^4$ | $6.8 \times 10^3$ | $5.2 \times 10^3$ |
| Ex. 11 | 115° C. | 180° C. | Poor | 58 | 30 | 55 | 75 | $1.0 \times 10^5$ | $2.1 \times 10^4$ | $1.0 \times 10^4$ | $5.6 \times 10^3$ | $3.5 \times 10^3$ |
| Com. Ex. 1 | 145° C. | 200° C. | Good | 63 | 53 | 75 | — | $7.7 \times 10^5$ | $2.8 \times 10^5$ | $1.5 \times 10^5$ | $8.9 \times 10^3$ | $6.1 \times 10^3$ |
| Com. Ex. 2 | 140° C. | 185° C. | Good | 63 | 50 | 75 | 90 | $6.4 \times 10^5$ | $2.1 \times 10^5$ | $1.9 \times 10^5$ | $7.1 \times 10^3$ | $3.8 \times 10^3$ |
| Com. Ex. 3 | 125° C. | 160° C. | Good | 61 | 40 | 75 | 90 | $1.8 \times 10^5$ | $2.1 \times 10^4$ | $1.2 \times 10^4$ | $8.9 \times 10^2$ | $4.8 \times 10^2$ |
| Com. Ex. 4 | 140° C. | 185° C. | Very poor | 48 | 44 | 75 | 90 | $6.4 \times 10^5$ | $1.7 \times 10^5$ | $7.9 \times 10^4$ | $5.1 \times 10^3$ | $2.9 \times 10^3$ |
| Com. Ex. 5 | 135° C. | 190° C. | Good | 63 | 48 | 75 | 77 | $5.7 \times 10^5$ | $1.7 \times 10^5$ | $1.3 \times 10^5$ | $9.4 \times 10^3$ | $8.1 \times 10^3$ |

FX: Fixability
MF: Minimum Fixable Temperature
HO: Hot Offset
TSS: Thermostable Storage Stability Table 2 shows that the toners of Examples including a polyester resin having good low-temperature fixability and a fixing supplemental component, and quickly changing G' at low temperature and holding G' at high temperature have good low-temperature fixability and hot off set resistance. Further, each of the toners has both of thermostable storage stability and low-temperature fixability because of including the fixing supplemental component as an independent crystalline domain.

The toner of Comparative Example 1 is equivalent to the toner of Example 1 except for excluding the fixing supplemental component, and therefore the toner has high G' at low temperature and deteriorates in low-temperature fixability.

The toner of Comparative Example 2 including a styrene-acrylic resin does not have sufficient low-temperature fixability as a toner including a polyester resin does. In addition, the toner has high G' at low temperature and does not have sufficient low-temperature fixability because the styrene-acrylic resin has less compatibility with the fixing supplemental component.

The toner of Comparative Example 3 excluding the prepolymer forming a polymeric resin component in the toner has too low G' at high temperature to have hot offset resistance.

The toner of Comparative Example 4 replacing the fixing supplemental component with a resin having a low Tg does not have sufficiently low G' at low temperature and deteriorates in low-temperature fixability.

The toner of Comparative Example 5 including a fixing supplemental component having insufficient compatibility with a polyester resin and a polymeric component (prepolymer) in a large amount by weight does not have sufficiently low G' at low temperature and deteriorates in low-temperature fixability.

The toners of Examples can be used in low-temperature fixing systems, have good offset resistance and do not contaminate fixers and images much. Further, the toners of Examples have good thermostable storage stability and can form high-definition toner images for long periods.

This application claims priority and contains subject matter related to Japanese Patent Application No. 2009-137227, filed on Jun. 8, 2009, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner, comprising:

a colorant;

a binder resin;

a release agent;

a fixing supplemental component, wherein the fixing supplemental component is a crystalline polyester having an endothermic peak (T2-cp) not less than 60° C. and less than 80° C. when subjected to a second DSC heating, and the toner has a storage elastic modulus G' (Pa) satisfying the following conditions:

$$5.0\times10^4<G'<5.0\times10^5 \text{ at } 80^\circ \text{ C.}$$

$$1.0\times10^4<G'<1.0\times10^5 \text{ at } 90^\circ \text{ C.}$$

$$5.0\times10^3<G'<5.0\times10^4 \text{ at } 100^\circ \text{ C.}$$

$$1.0\times10^3<G'<1.0\times10^4 \text{ at } 120^\circ \text{ C.}$$

$$1.0\times10^3<G'<1.0\times10^4 \text{ at } 150^\circ \text{ C.}$$

2. The toner of claim 1, wherein the fixing supplemental component is a crystalline polyester having an endothermic peak (T2-cp) not less than 60° C. and less than 80° C. when subjected to a second DSC heating, and the T2-cp satisfies the following relationship:

$$(T2\text{-}cs2)-10<(T2\text{-}cp<(T2\text{-}cs1)+10$$

wherein the T2-csl represents an endothermic shoulder temperature 1 and T2-cs2represents an endothermic shoulder temperature 2 when the crystalline polyester is subjected to the second DSC heating.

3. The toner of claim 1, wherein the toner satisfies the following conditions when subjected to differential scanning calorimetry (DSC):

$$50^\circ \text{ C.}<Tg1st<70^\circ \text{ C.}$$

$$20^\circ \text{ C.}<Tg2nd<50^\circ \text{ C.}$$

wherein Tg1st and Tg2nd are glass transition temperatures of the toner when heated for the first time and second time, respectively.

4. The toner of claim 1, wherein the toner satisfies the following conditions when subjected to differential scanning calorimetry (DSC):

$$50^\circ \text{ C.}<Tg1st<70^\circ \text{ C.}$$

$$30^\circ \text{ C.}<Tg2nd<50^\circ \text{ C.}$$

wherein Tg1st and Tg2nd are glass transition temperatures of the toner when heated for the first time and second time, respectively.

5. The toner of claim 1, wherein the fixing supplemental component is a dibasic ester compound having a melting point of from 60 to 100° C., which is formed by esterifying a dicarboxylic acid having 2 to 6 carbon atoms and a monohydric aliphatic alcohol.

6. The toner of claim 1, wherein the binder resin comprises a polyester resin.

7. The toner of claim 1, wherein the toner is prepared by a method, comprising:

dissolving or dispersing toner constituents in an organic solvent to prepare a solution or a dispersion;

dispersing the solution or the dispersion in an aqueous medium; and removing the organic solvent.

8. The toner of claim 1, wherein the toner constituents comprise an active-hydrogen-group-containing compound and a polymer reactable with the active-hydrogen -group-containing compound, and wherein the active-hydrogen-group-containing compound reacts with the polymer reactable therewith in the aqueous medium to form an adhesive base material.

9. The toner of claim 1, wherein the release agent is a hydrocarbon wax having a melting point of from 60 to 90° C.

10. A developer comprising the toner according to claim 1.

11. A developer container containing the developer according to claim 8.

12. A process cartridge detachable from image forming apparatus, comprising:

an electrostatic latent image bearer configured to bear an electrostatic latent image; and an image developer configured to develop the electrostatic latent image with the toner according to claim 1.

13. An image forming method, comprising:

irradiating an electrostatic latent image bearer to form an electrostatic latent image;

developing the electrostatic latent image with the toner according to claim 1 to form a visual image;

transferring the visual image onto a recording medium; and fixing the visual image on the recording medium.

14. An image forming apparatus, comprising:

an electrostatic latent image former configured to form an electrostatic latent image on an electrostatic latent image bearer;

an image developer configured to develop the electrostatic latent image with the toner according to claim 1 to form a visual image;

a transferer configured to transfer the visual image onto a recording medium; and a fixer configured to fix the visual image on a recording medium.

15. The toner of claim 1, wherein the crystalline polyester has a diameter of from 10 nm to 3 μm.

16. The toner of claim 1, wherein the crystalline polyester has a diameter of from 50 nm to 1 μm.

* * * * *